United States Patent [19]

Shimizu

[11] Patent Number: 4,479,732

[45] Date of Patent: Oct. 30, 1984

[54] WRITING INSTRUMENT WITH SEALING CAP RETAINED IN TIP

[75] Inventor: Kazuo Shimizu, Osaka, Japan

[73] Assignee: Ancos Co., Ltd., Osaka, Japan

[21] Appl. No.: 394,987

[22] Filed: Jul. 2, 1982

[30] Foreign Application Priority Data

| | | | |
|---|---|---|---|
| Jul. 2, 1981 | [JP] | Japan | 56-102238 |
| Sep. 3, 1981 | [JP] | Japan | 56-137779 |
| Nov. 11, 1981 | [JP] | Japan | 56-167110[U] |

[51] Int. Cl.[3] ..... B43K 9/00; B43K 7/12; B43K 8/02

[52] U.S. Cl. ..... 401/107; 401/108; 401/202; 401/213; 401/243

[58] Field of Search ..... 401/107, 108, 213, 202

[56] References Cited

U.S. PATENT DOCUMENTS

| | | | |
|---|---|---|---|
| 3,525,573 | 8/1970 | Fend | 401/107 |
| 3,914,059 | 10/1975 | Mitsuya | 401/67 |
| 4,315,695 | 2/1982 | dos Santos et al. | 401/107 X |

FOREIGN PATENT DOCUMENTS

| | | | |
|---|---|---|---|
| 2806377 | 8/1979 | Fed. Rep. of Germany | 401/107 |
| 443588 | 12/1948 | Italy | 401/107 |
| 454695 | 1/1950 | Italy . | |
| 566613 | 9/1957 | Italy | 401/107 |
| 52-49123 | 4/1977 | Japan . | |
| 55-11902 | 2/1980 | Japan . | |
| 55-64915 | 5/1980 | Japan . | |
| 653141 | 5/1951 | United Kingdom | 401/107 |

*Primary Examiner*—Steven A. Bratlie

*Attorney, Agent, or Firm*—Sughrue, Mion, Zinn, Macpeak and Seas

[57] ABSTRACT

A writing instrument such as a ball point or felt tip pen is provided with a seal member selectively engageable with the writing tip, the sealing member being movable from a position plugging the pen through hole to a position allowing the front end of the writing member to freely pass through the through hole for writing.

23 Claims, 73 Drawing Figures

WRITING INSTRUMENT WITH SEALING CAP RETAINED IN TIP

BACKGROUND OF THE INVENTION

The present device relates to a writing instrument wherein the writing tip of the writing member may be effectively sealed when the writing tip is held in its accomodated position in an accommodating portion of the pen. The present device can be applied to a writing instrument such as a fountain pen, a felt pen or a ball-point pen, but can be mostly advantageously used when it is applied to a writing instrument such as the felt pen.

Writing pens having an improved sealing effect when the writing tip of the writing member is held in an accommodated state have been the subject of several patent documents. A writing instrument which has its barrel formed at its leading end with an accommodating portion so that its writing tip may be accommodated in that accommodating portion when it is held in its accommodated state is disclosed in applications such as Japanese Patent Application No. 50-122932 (i.e., Japanese Patent Laid-Open No. 52-49123), Japanese Utility Model Application No. 55-11902 and Japanese Utility Model Application No. 55-64915. However, the devices described in all of these applications are constructed such that there are formed, in juxtaposition to each other, in the leading end portion of a barrel, a through hole, through which the writing member can move into and out of the barrel, and an accommodating portion for accommodating the writing member. As a result, the leading end portion of the writing member is inevitably thickened such that the shape of the leading end portion cannot be made sharp. Another drawback that the writing member has to be formed into a special shape such that the writing tip protrudes from an eccentric position of the writing member.

SUMMARY OF THE INVENTION

It is, therefore, an object of the present device to provide a writing instrument of the aforementioned type, which can have a convergent leading end portion to give a smart appearance.

It is a further object of the present invention to inexpensively provide a writing instrument which enjoys an excellent sealing effect when the writing tip of its writing member is held in its accommodated state.

DETAILED DESCRIPTION OF THE INVENTION

Figure 1:
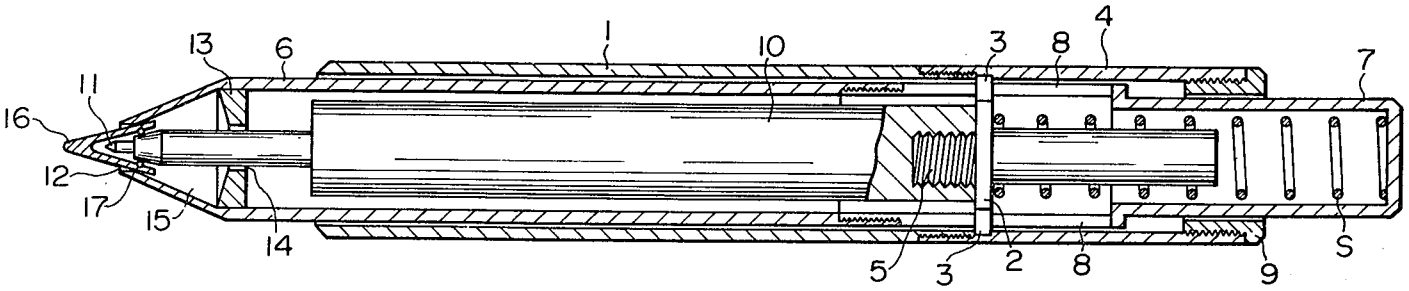
FIG. 1 is a longitudinal section showing a first embodiment of the present device.

The present device will be described in the following, in connection with several embodiments thereof, with reference to the acccompanying drawings. FIG. 1 is a longitudinal section showing a first embodiment of the present device, in which reference numeral 1 indicates a front barrel member. A separate connector 2 is formed at its upper and lower portions with two legs 3. The front barrel member 1 is connected to a rear barrel member 4 by applying the legs 3, 3 to the rear end of the front barrel member 1 and by screwing the front end portion of the rear barrel member 4 onto the rear end portion of the front barrel member 1, and the connector 2 is fixed by clamping the legs 3, 3 between the front and rear barrels. The legs may have their outer circumferences formed integrally with ring-shaped portions to facilitate the clamping. The connector 2 is formed at its front side center with a male screw 5 which extends forwardly. The front and rear barrel members 1 and 4 together constitute the barrel of the writing instrument. A sliding cylinder 6 is fitted in the barrel thus constructed so that it can move back and forth. A cylindrical button member 7 is connected to the sliding cylinder 6 by being screwed into the back of the latter. The member 7 is formed at its front portion with two diametrically opposite slits 8, 8 which extend in the axial direction. The legs 3, 3 of the connector 2 are fitted in the slits 8, 8, respectively. Between the connector 2 and the member 7, there is sandwiched a spring S, by which the sliding cylinder 6 and the member 7 are biased backwardly. Moreover, a ring 9 is screwed into the inner circumference of the rear end of the rear barrel member 4 to thereby restrict the backward movement of the sliding cylinder 6 and the member 7.

A writing member 10 is fitted in the sliding cylinder 6. The writing member 10 is formed at its rear end with a recess which is internally threaded, and member 10 and the barrel are connected by screwing the female screw onto the male screw 5 of the connector 2. The writing member 10 is equipped with a writing tip 11 at its leading end.

The sliding cylinder 6 has a converging front portion and is formed at its leading end with a through hole 12. The writing tip 11 of the writing member 10 moves through the hole 12 into and out of the sliding cylinder 6. Moreover, the leading end portion of the sliding cylinder 6 at the back of the through hole 12 has its inner wall formed into a conical shape, and a partition 13 is fixed in the inner wall of the sliding cylinder 6 and adjacent to the conical portion. The partition 13 is formed at its center with a center hole 14 through which the leading end portion of the writing member 10 moves back and forth. That space in front of the partition 13, which is defined by the partition 13, provides a conical chamber 15. In this conical chamber 15, there is accommodated a seal cap 16 having a conical shape, which is shaped and sized to cap the leading end portion of the writing member 10. The seal cap 16 is shaped and sized so that its leading end portion may protrude halfway out of the through hole 12 of the sliding cylinder 6, or such that it may be wholly accommodated in the space in the conical chamber 15 leaving room for the thickness of the leading end portion of the writing member 10. A seal ring 17 is attached to the inner wall of the seal cap 16 in the vicinity of the rear end thereof.

Moreover, FIG. 1 shows the sealed state in which the writing tip 11 of the writing member 10 is sealed by the seal cap 16. In this state, the front half of the seal cap 16 protrudes out of the through hole 12 of the sliding cylinder 6, and the writing tip 11 protrudes into the seal cap 16 so that it is sealed by the seal ring 17. Incidentally, the air vent hole of the writing member 10 is formed in front of the position where the seal ring 17 abuts in this state, such that the cap 16 forms an air chamber surrounding the vent hole. Moreover, the force protruding the leading end portion of the writing member 10 into the seal cap 16 is established by the force of the spring S, which tends to bias the sliding cylinder 6 backward.

Figure 2:
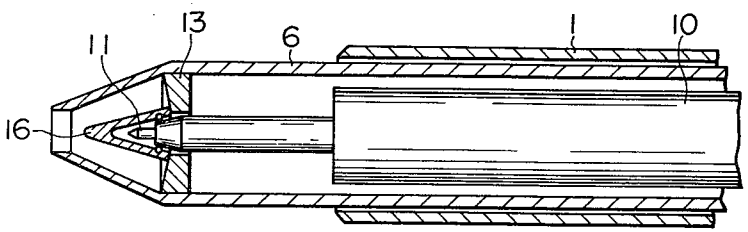
FIGS. 2, 3, 4 and 5 are longitudinal sections of essential portions for explaining the operation of the first embodiment, respectively.
Figure 4:
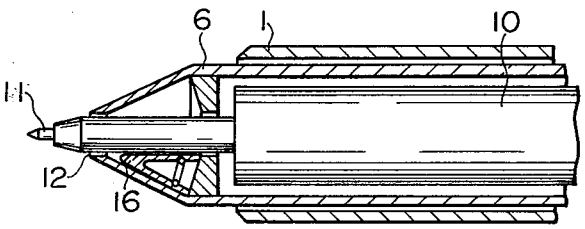
Figure 3:
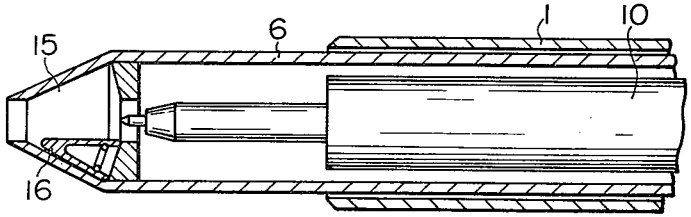
Figure 5:
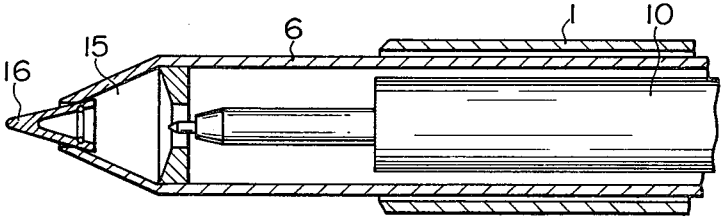

When it is intended to change from the sealed state to the writing state, the writing instrument is held in a horizontal or like position. If the member 7 is depressed, the sliding cylinder 6 is brought forward, but the seal cap 16 is left on the leading end portion of the writing member 10 so that its rear end abuts against the partition 13, as shown in FIG. 2. If the sliding cylinder 6 further advances, the seal cap 16 moves out of engagement with the leading end portion of the writing member 10 to fall down into the bottom of the cylindrical chamber 15, as shown in FIG. 3. Since, at this time, the seal cap 16 is held completely apart from the front position of the writing member 10, the member 7 and the sliding cylinder 6 are retracted by the force of the spring S, if the pushing force on the member 7 is released, so that the writing tip 11 protrudes out of the leading end of the sliding cylinder 6 to thereby achieve the writing state shown in FIG. 4. In order to switch from the writing state to the sealed state, on the contrary, the member 7 is depressed with the leading end of the writing instrument directed downwardly. Then, the sliding cylinder 6 is moved forward. However, when the sliding cylinder 6 advances to a position where the writing tip 11 does not block the advance of the seal cap 16, the seal cap 16 slides down the conical wall of the conical chamber 15 until its leading end protrudes out of the through hole 12 of the sliding cylinder 6, as shown in FIG. 5. Now, if the pushing operation on the member 7 is released, the sliding cylinder 6 and the seal cap 16 are retracted to restore the state shown in FIG. 1, in which the seal cap 16 is fitted in the leading end portion of the writing member 10.

Figure 6:
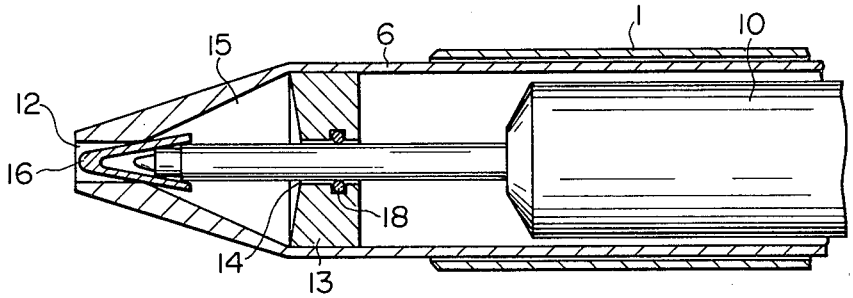
FIGS. 6 and 7 are longitudinal sections of essential portions for explaining the operation of a second embodiment, respectively.
Figure 7:
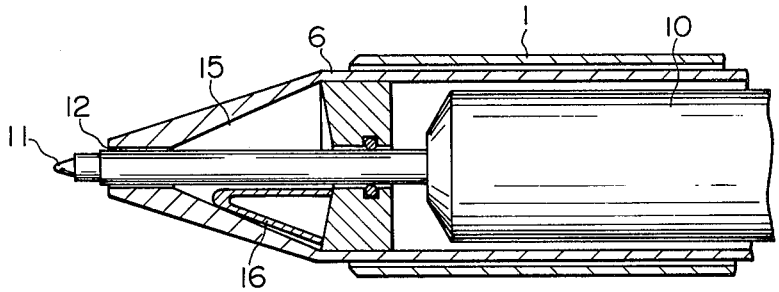

A second embodiment of the present device will now be described with reference to FIGS. 6 and 7. In this second embodiment, a seal ring 18 is fitted in the inner wall of the rear end of the hole 14 of the partition 13, which is fixed at the back of the conical chamber 15 formed in the leading end portion of the sliding cylinder 6, to thereby seal the clearacne between the partition 13 and the writing member 10. On the other hand, the sealing effect of the front portion of the conical chamber 15 is obtained between the inner wall of the through hole 12 of the sliding cylinder 6 and the outer circumference of the seal cap 16. As a result, the air vent hole to be formed in the writing member 10 may be positioned in front of the position, in which the seal ring 18 is located in the sealed state of FIG. 6. Incidentally, FIG. 7 shows the writing state of the second embodiment.

Figure 8:
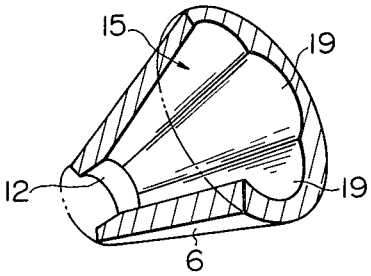
FIG. 8 is a partially sectional perspective view showing essential portions of a third embodiment.

Next, a third embodiment of the present device will be described with reference to Fig. 8. FIG. 8 is a partially cut-away perspective view showing the leading end portion of the sliding cylinder 6. The chamber 15 is formed into a conical shape, and the sliding cylinder 6 has the inner wall of its leading end portion formed with a plurality of guide grooves 19 which are cut away in an arcuate shape. Each of the guide grooves 19 is made deeper at the back but becomes shallower and shallower forward the front. In the writing state, the seal cap 16 is snugly fit in one of the guide grooves 19. On the other hand, when the sliding cylinder 6 is brought forward, while the leading end of the writing instrument is directed downwardly so as to establish the sealed state, the seal cap 16 is guided by that particular guide groove 19 until its leading end is fitted in the through hole 12 of the sliding cylinder 6.

Figure 8B:
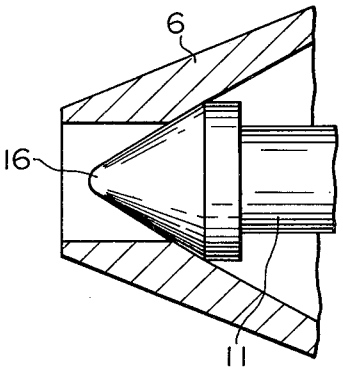
FIGS. 8*a* and 8*b* illustrate modified seal cap and cylinder end structures.
Figure 8A:
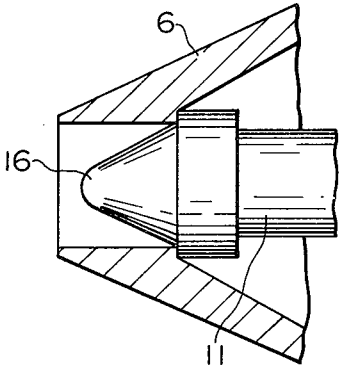

FIGS. 8*a* and 8*b* illustrate slightly modified constructions of the seal cap and the forward end of the sliding cylinder 6.

In the embodiments thus far described, incidentally, if the leading end portion of the sliding cylinder 6 is made transparent, it is conveniently possible to confirm from the outside both the movements of the seal cap 16 and whether or not the leading end portion of the writing member 10 is fitted in position in the seal cap 16. Moreover, if the seal cap 16 is colored, when the leading end portion of the sliding cylinder 6 is not transparent, the leading end of the colored seal cap 16 can be seen through the through hole 12 to thereby confirm that the leading end portion of the writing member 10 is sealed.

As has been apparent from the description thus far made, in the writing instrument according to the present device, if the member 7 connected to the back of the sliding cylinder 6 is depressed with the writing instrument being held in a horizontal or like position, the seal cap 16, which has plugged the through hole 12 formed in the leading end of the sliding cylinder 6, falls down into the conical chamber 15, which is formed in the leading end portion of the sliding cylinder 6, and is brought out of the way of the leading end portion of the writing member 10. If the pushing force of the member 7 is then released, the sliding cylinder 6 is retracted by the force of the spring S so that the writing tip 11 protrudes out of the through hole 12 of the sliding cylinder, thus achieving the writing state. If the member 7 is then depressed while the leading end of the writing instrument is directed downward, the sliding cylinder 6 is moved forward so that the seal cap 16 falls down to plug the through hole 12 of the sliding cylinder 6. If the pushing action of the member 7 is released, the sliding cylinder 6 is then retracted so that the writing tip 11 is fitted in and sealed by the seal cap 16. As a result, switching between the writing state and the sealed state can be accomplished with ease. The sealing effect of the writing tip 11 in the sealed state can be effectively obtained whether the tip 11 is in the seal cap 16 or in the conical chamber 15. Moreover, since the leading end portion of the sliding cylinder 6 is constructed with the through hole 12 and such that the conical chamber 15 is formed just back of the through hole, the leading end portion of the sliding cylinder 6 is formed into a converging sharp shape to allow an excellent design. Furthermore, if the leading end portion of the writing member 10 is made slender, the through hole 12 of the sliding cylinder 6 can be made so small as to allow only that leading end portion to pass therethrough. As a result, the seal cap 16 can be made just large enough to plug the through hole 12 so that the writing instrument can be made slender as a whole, while having its leading end portion designed with a sharp taper.

Figure 10:
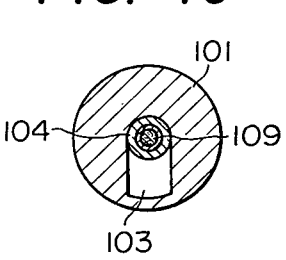
FIGS. 10 and 11 are sectional views taken along lines X—X and XI—XI of FIG. 1, respectively.
Figure 9:
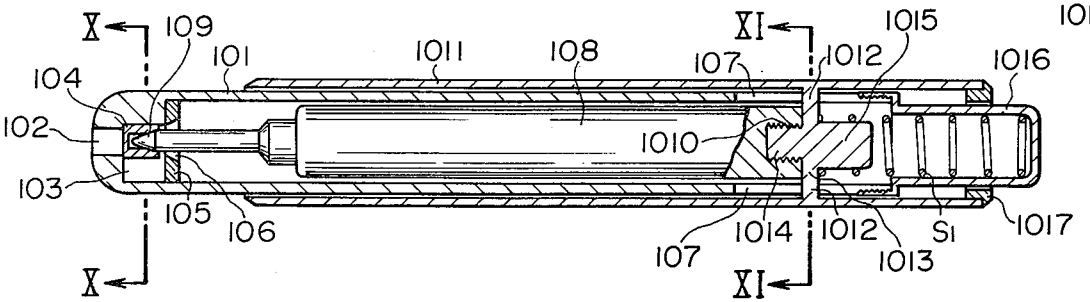
FIGS. 9, 12, 13, 14, 15 and 16 are longitudinal sections explaining the operations of a further embodiment of the present invention, respectively.

FIG. 9 is a longitudinal section showing a firs of several similar embodiments of the present invention as applied to a felt pen having a vent hole at its leading end. Reference numeral 101 indicates a sliding cylinder. This sliding cylinder 101 is formed at its front end center with a through hole 102 through which the writing tip of a writing member is brought into and out of the writing instrument. Moreover, the sliding cylinder 101 is formed at its front portion and at the back of the through hole 102 with an accommodating chamber 103 which extends in a generally elliptical shape downwardly or radially outwardly from the back of the through hole 102. The construction thus far described is clearly seen from FIG. 10 which is a section taken along line X—X of FIG. 9. A cap-shaped seal cap 104 is fitted in the accommodating chamber 103 such that its center recess opens rearwardly. The seal cap 104 is made to have a slightly larger external diameter than that of the through hole 102 so that it can be moved up and down, i.e., in the radial direction, within the accommodating chamber 103. On the other hand, the seal cap 104 is formed with an air chamber which is sized so as to allow the air in the aforementioned writing member to be recirculated through an air vent hole formed at the leading end of the writing portion of the writing member. A slight amount of air is reserved in the chamber when the cap is in place over the writing point. (Reference should be made to FIGS. 18, 19, 21 and 22, as will be described hereinafter.) Thus, the seal cap 104 moves to the rear of the through hole 102, when it is in its highest or center position, to plug the through hole, and completely opens the hole when it is in the lowermost or radially outer position. After the seal cap 104 has been fitted in the accommodating chamber 103, a disc 105 is inserted from the back of the sliding cylinder 101 and is press-fit, while plugging the accommodating chamber 103, until it is fixed in the sliding cylinder. The disc is formed with a tapered hole 106, which has its internal diameter made slightly smaller than the external diameter of the seal cap to thereby prevent the seal cap from coming out backwards. The center hole 106 of the disc 105 is provided to allow the writing tip of the writing member to be brought therethrough into and out of the writing instrument. The sliding cylinder is formed at its trailing end portion with two diametrically opposite slits 107, 107, which extend in axial directions from the rear thereof.

In the sliding cylinder 101, there is fitted a writing member 108, which is equipped with the writing tip 109 at its front end. The writing member 108 is formed at its rear end center with a recess 1010.

Figure 11:
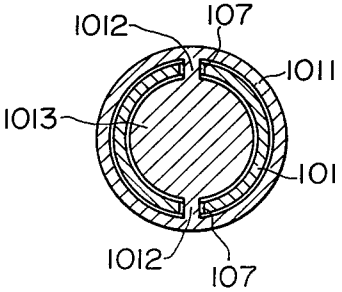

A barrel 1011 is fitted on the outer circumference of the sliding cylinder. A disc 1013 is attached through two diametrically opposite legs 1012, 1012 to the inside of the rear portion of the barrel. Specifically, the legs 1012 are fitted in the slits 107 of the sliding cylinder. The construction thus far described is shown in FIG. 11 which is a section taken along line XI—XI of FIG. 9. The disc 1013 is formed at its front side center with a forward protrusion 1014, which is fitted in the recess 1010 of the writing member to thereby attach the writing member to the barrel. The disc 1013 is also formed at its rear side center with a backward protrusion 1015.

A cap 1016 is screwed from the rear onto the rear end of the sliding cylinder 101. (A reinforcing ring is fitted in the inner wall of the rear end portion of the sliding cylinder to reinforce the portions formed with the slits 107.) Between the disc 1013 of the barrel 1011 and the cap 1016, moreover, there is sandwiched a spring $S_1$, which biases backward the sliding cylinder 101 and so on relative to the barrel. A ring 1017 is fitted in the inner circumference of the rear end of the barrel 1011 so that the cap can be moved back and forth in the ring 1017.

Figure 12:
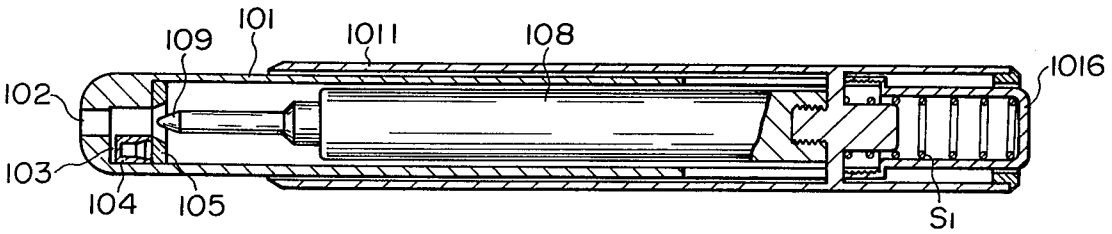
Figure 13:
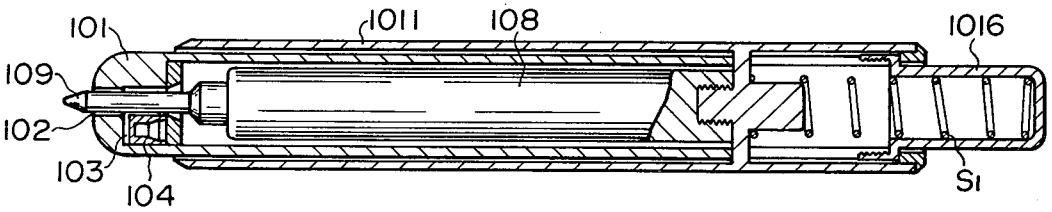

Moreover, FIG. 9 shows the state in which the seal cap is positioned at the back of the through hole of the sliding cylinder to thereby plug the through hole, and in which the writing tip 109 of the writing member 108 is fitted in the recess of the seal 104. This state corresponds to the accommodated state of the writing tip used when the writing instrument is not in use. The sealed state of the writing tip is maintained since the seal cap 104 is pushed onto the writing tip by the force of the spring $S_1$. When it is intended to effect the writing state, the cap 1016 is depressed, as shown in FIG. 12. The cap and the sliding cylinder advance, while compressing the spring $S_1$, until the seal cap 104 is brought into abutment against the disc 105 and out of engagement with the writing tip of the writing member. Then, the seal cap is allowed to fall down under its own weight into the accommodating chamber to thereby release the plugged state of the through hole. Now, if the cap 1016 is released, the cap and the sliding cylinder are retracted by the force of the spring $S_1$ so that the writing tip 109 of the writing member protrudes from the through hole of the sliding cylinder to thereby achieve the writing state shown in FIG. 13. A writing operation may now be conducted.

Figure 14:
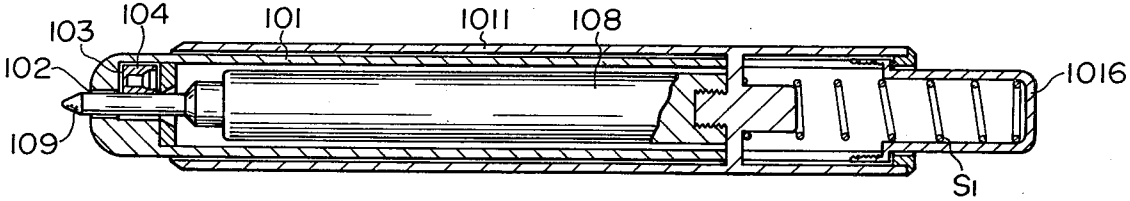
Figure 15:
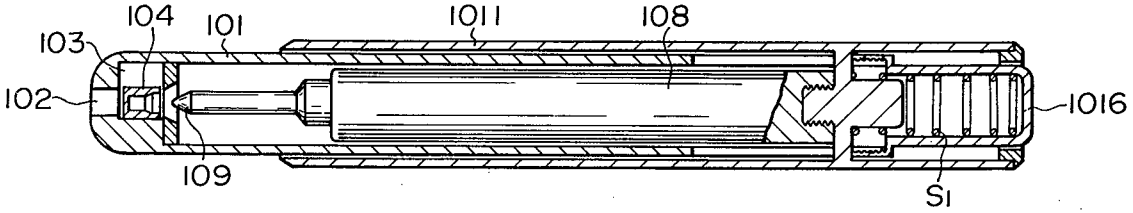
Figure 16:
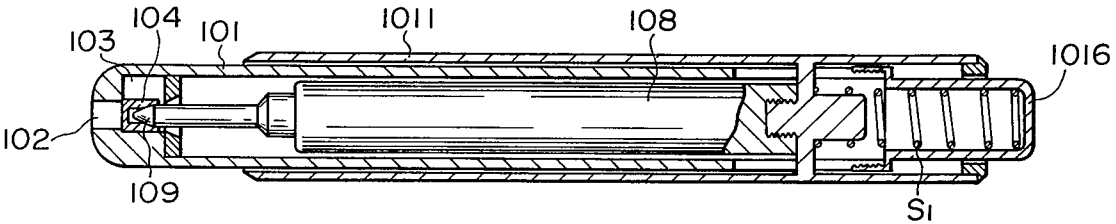

Next, if the accommodated state is to be resumed, the writing instrument is first turned upsidedown to turn the upper side of the barrel 1011 downward and the lower side upward. This state is shown in FIG. 14. Now, if the cap 1016 is depressed, the sliding cylinder is brought forward until the seal cap falls in front of the writing tip into the accommodating chamber 103 to plug the through hole 102, to thereby effect the state shown in FIG. 15. Now, if the cap is released, the sliding cylinder is retracted by the spring $S_1$ so that the seal cap is retracted to fit and seal the writing tip of the writing member 108, to achieve the storage state shown in FIG. 16.

Figure 17:
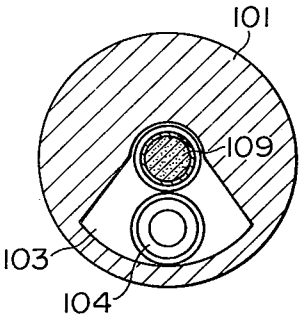

Next, a further embodiment of the present invention will be described with reference to FIG. 17. Whereas the accommodating chamber 103 of the prior embodiment has a generally elliptical shape, the accommodating chamber of the second embodiment has a sectorial sectional shape. With this shape, the seal cap will easily fall to the position back of the through hole 102 unless the accommodating chamber is positioned as in FIG. 17.

Figure 18:
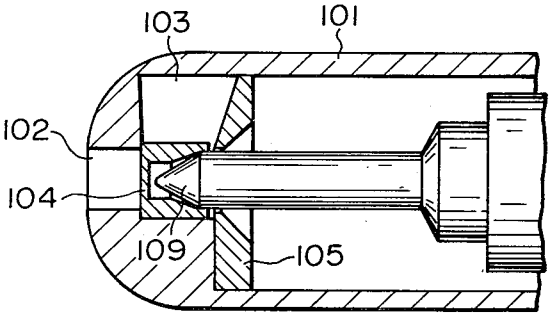
FIGS. 17, 18, 19, 21 and 22 are sectional views showing the essential portions of five further embodiments of the present invention, respectively.

A further modification will now be described with reference to FIG. 18. The accommodating chamber 103 of this embodiment has a longitudinal section in the shape of a funnel. This is devised to facilitate the fall to the position back of the through hole 102 by the seal cap 104.

Figure 19:
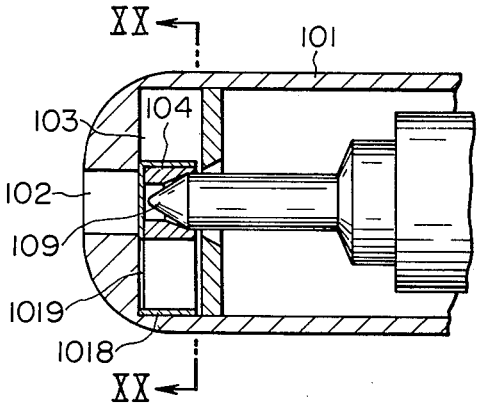
Figure 20:
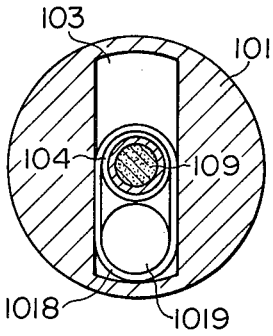
FIG. 20 is a section taken along line XX—XX of FIG. 19.

Another embodiment of the present invention will be described with reference to FIGS. 19 and 20. The accommodating chamber 103 of this embodiment is vertically or diametrically elongated, and the seal cap 104 is disposed close to the upper end of a support 1018 which has an elliptical cap shape. The support 1018 is formed at its lower end with a hole 1019 which is sized so as to be equal to that of the through hole 102. Thus, the movement of the seal cap is smoothened.

Figure 21:
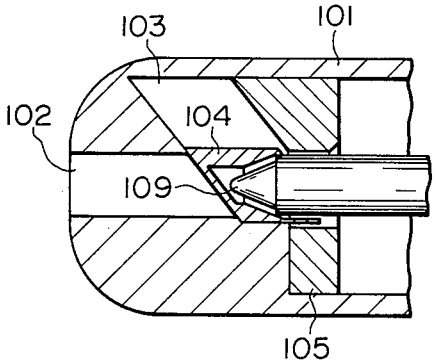

A further modification is shown in FIG. 21. The accommodating chamber 103 of this arrangement is formed with an inclination in the longitudinal direction. Thus, when the writing instrument cap is depressed while having the front end thereof directed upwardly, the seal cap 104 falls to the position back of the through hole. When this operation is accomplished with that front end being directed downwardly, on the contrary, the seal cap leaves the position back of the through hole. In other words, the seal cap can be moved back and forth by depressing the cap and directing the front end of the writing instrument either downwardly or upwardly.

Figure 22:
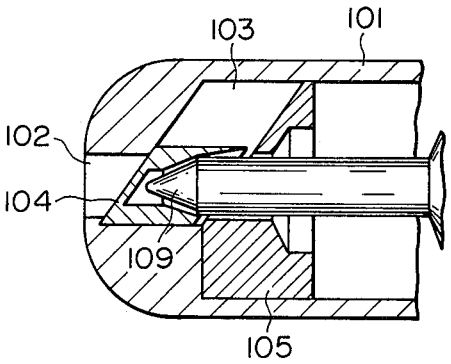

Another modification of the present invention will be described with reference to FIG. 22. The accommodating chamber 103 of this embodiment is inclined in the direction opposite to that of the accommodating chamber of the preceding embodiment. As a result, the operations of this embodiment are reversed from those of the prior embodiment.

Figure 23:
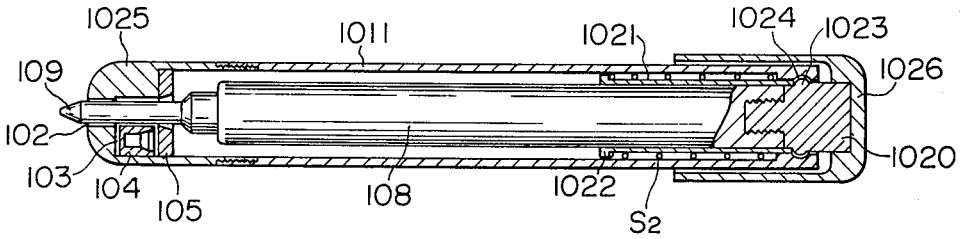
FIGS. 23, 23*a* and 25*a* are longitudinal sections showing further modifications of the present invention, respectively.

Another modification of the present invention will be described with reference to FIG. 23. Whereas the prior embodiments are of the push-button type, the writing state and the accommodated state are established in the present embodiment by pulling or releasing the writing member 108 with two hands. Into the rear end of the writing member 108, specifically, there is screwed or otherwise connected a connecting member 1020 having a front end, on which the rear end of a cylindrical member 1021 is fitted. This cylindrical member is not so long, but is formed with a flange 1022 at its leading end. Between this flange and the stepped portion formed in the inner circumference close to the rear end of the barrel 1011, there is sandwiched a spring $S_2$, by which the cylindrical member 1021 and so on are biased forwardly relative to the barrel. The connecting member 1020 is formed at its outer circumference with a rib 1023, whereas the barrel 1011 is formed at the inner circumference thereof close to the rear end with a groove 1024. The rib 1023 is fitted in the groove 1024 when in the writing state in which the writing member 108 and so on have been moved forward, to bear the writing pressure. However, the rib 1023 and the groove 1024 may be dispensed with, leaving only the spring $S_2$ if the writing pressure to be applied is not so high. Into the front of the barrel, moreover, there is screwed a base 1025 which has a construction such as is formed at the front end portion of the sliding cylinder 101 in the embodiment of FIG. 9.

On the rear end of the connecting member 1020, on the other hand, there is fitted an outer cylinder 1026 which is in the shape of a cap. In this embodiment thus constructed, when the barrel 1011 is gripped by one hand and the outer cylinder 1026 is gripped and pulled by the other hand, the writing member 108 is relatively retracted to enable the seal cap 104 to be moved. In the embodiment of FIG. 9 the barrel 1011 and the writing member 108 were made integral, and the sliding cylinder made movable relative thereto. In this embodiment, on the contrary, the writing member 108 is made movable relative to the barrel 1011.

Figure 23A:
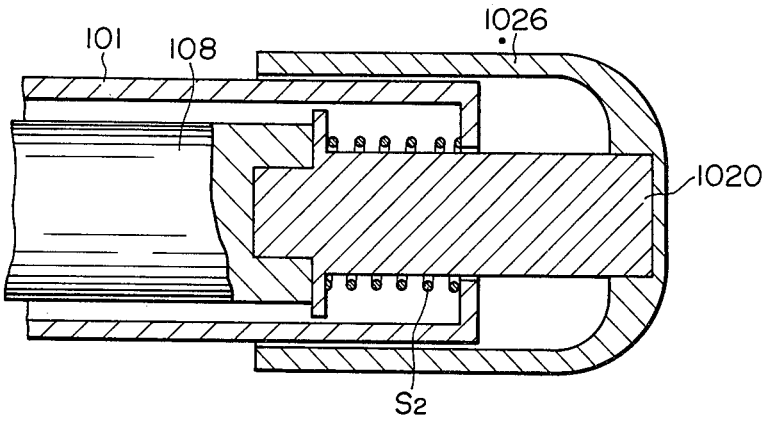

A similar embodiment of the present invention is shown in FIG. 23*a*, which also works by pulling or releasing the sliding cylinder using both hands. To the rear end of the refill or writing member 108 there is connected a connecting rod 1020, to the rear end of which a cap-shaped outer cylinder is attached. When one hand grips the outer 1026 as whereas the other hand pulls the sliding cylinder 101, this sliding cylinder 101 advances to allow the movement of the seal cap 104.

Figure 24:
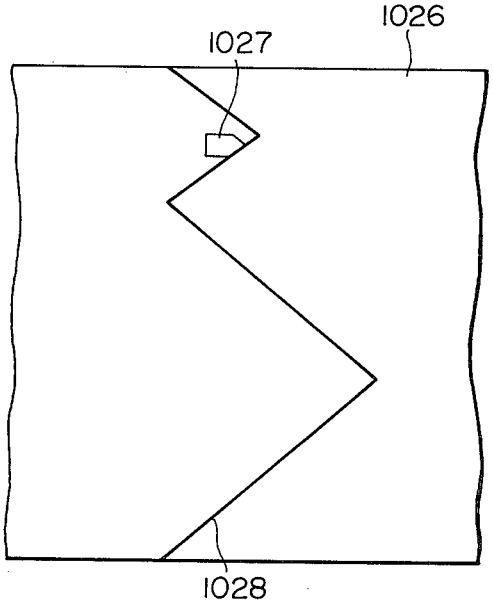
FIG. 24 is an exploded view showing the essential portion of a rotary operated embodiment of the present invention.

Now, further embodiment of the present invention will be described with reference to FIG. 24. This embodiment which uses a rotary type mechanism is a modification of the prior embodiments of FIG. 23 or 23*a*. In this embodiment, more specifically, the barrel 1011 is formed on its outer circumference with a projection 1027, whereas the outer cylinder 1026 is formed at its inner circumference with a cam wall 1028 which is composed of larger and smaller cam surfaces. When the outer cylinder 1026 is turned relative to the barrel, the projection 1027 is caused to follow the cam surfaces of the cam walls by the force of the spring $S_2$. The sealed state and the writing state are established when the projection 1027 is at the bottoms of the smaller and larger cam surfaces, respectively.

Next, a further embodiment of the present invention will be described with reference to FIG. 25*a*. Into the back of the writing member 108, there is screwed a connecting member 1029 having a rear end, into which the rear end of the barrel 1011 is screwed. On the barrel close to the front end thereof, there is fitted a cylindrical member 1030, which protrudes forward out of the barrel. Moreover, the cylindrical member 1030 is formed on the outer circumference of its rear end with a flange 1031, and a spring $S_3$ is sandwiched between that flange and the stepped portion formed at the inner circumference of the front end of the barrel 1011 to thereby bias the cylindrical 1030 member backward. In the front end of the cylindrical member, there is fitted a disc 105, to the front of which the base 1025 is attached. This base is formed with the through hole 102 and the accommodating chamber 103, in which the seal cap 104 is fitted.

Figure 25:
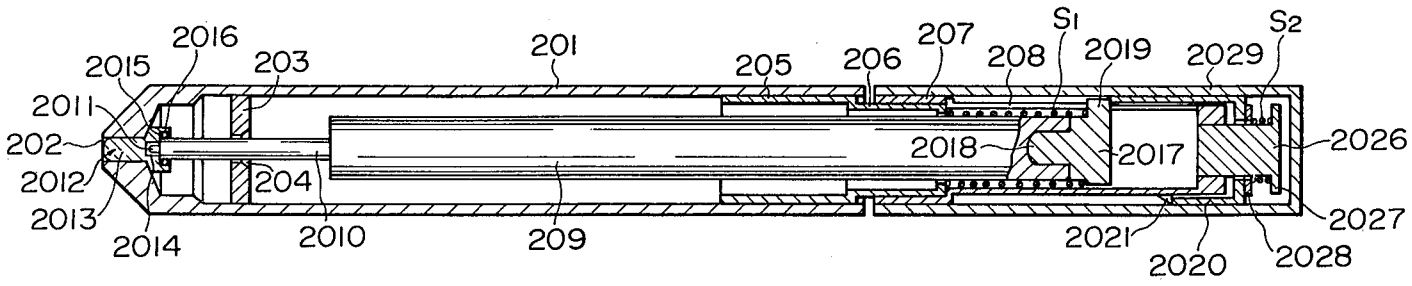
FIGS. 25, 27, 28 and 29 are sectional views showing the operation of another embodiment of the present device, respectively.
Figure 25A:
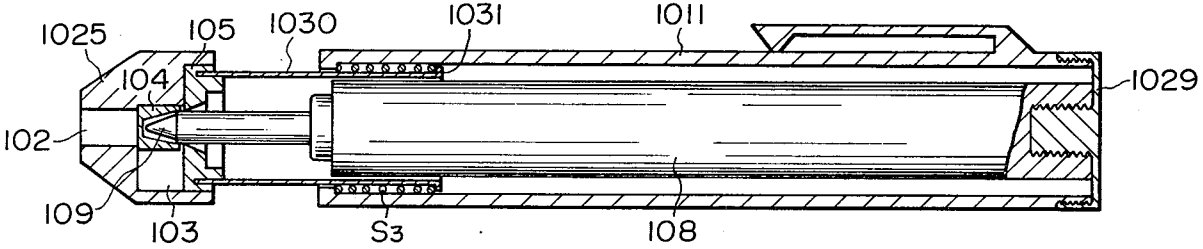

Moreover, FIG. 25*a* shows the accommodated state in which the seal cap 104 seals the writing tip 109 of the writing member 108. Since, in this state, the base 1025, the cylindrical member 1030 and so on are biased backwardly by the force of the spring $S_3$, the seal cap completely seals the writing tip of the writing member. Incidentally, the operation for changing this state to the writing state and the operation for returning such to the accommodated state are apparent from the description thus far made, and thus repeated explanations are omitted here. In the modification under consideration, the writing state or the sealed state is effected by the operation of moving the base 1025 forward or backward. Moreover, if a cap is integrated with the outer circumference of the base such that its trailing end slides while covering the front portion of the barrel 1011, a good appearance can be obtained since the cylindrical member 1030 cannot be seen from the outside when in the sealed state. In this case, however, if the cap is gripped for the writing operation, the writing pressure is borne by the spring $S_3$. Therefore, the cap and the barrel may be formed with such a rib and a groove similar to those of the embodiment of FIG. 23. FIG. 25 is a sectional view showing a first of several similar further embodiments of the present device, in which reference numeral 201 indicates a front barrel member. The front barrel member 201 has its leading end portion formed into a converging shape, which is formed with a through hole 202 for allowing the writing tip of the writing member to pass therethrough. In the front barrel member slightly at the back of the through hole, moveover, there is fitted a disc-shaped stopper 203, which is formed at its center with a hole for allowing the writing tip of the writing member to pass therethrough.

In the inner circumference in the vicinity of the rear end of the front barrel member 201, there is fitted a cylindrical member 205 which has its rear portion formed into a reduced portion 206 having a slightly smaller diameter, and protruding backward from the rear end of the front barrel member 201. On the reduced portion, there is fitted, from the back, another cylindrical member 207 which is formed with an axially extending slit 208. A writing member 209 is fitted in the front barrel member, the cylindrical member 205 and the cylindrical member 207. The front portion of the writing member is diametrically reduced to a reduced portion 2010 equipped with a writing tip at its leading end. The reduced portion is made movable back and forth in the hole 204 of the stopper 203. In the front barrel member in front of the stopper, moreover, there is fitted a seal member 2012 which has its front portion diametrically reduced down to a reduced portion 2013 having a diameter so as to be snugly fitted in the through hole of the front barrel member. The seal member 2012 is formed at its rear side with an accommodating hole 2014 to fit the writing tip of the writing member therein. The rear portion of the accommodating hole 2014 is diametrically enlarged through a stepped portion 2015 to form an enlarged portion, in which a seal ring 2016 is fitted. When the writing tip of the writing member is fitted in the accommodating hole 2014, the leading end of the reduced portion 2010 abuts the stepped portion 2015, and the seal ring 2016 seals the outer circumference of the reduced portion.

The writing member is formed at its rear end with a round hole, in which a column 2018 formed to protrude forward from a sliding member 2017 is fitted to thereby attach the sliding member 2017 to the back of the writing member. A spring $S_1$ is sandwiched between the reduced portion 206 of the cylindrical member 205 fitted in the front barrel member and the sliding member 2017 to thereby bias the writing member 209 and the sliding member 2017 backward. The sliding member 2017 is formed at one portion with a projection 2019 which protrudes toward the outer circumference to the outside of the cylindrical member 207 through the slit 208 formed in the cylindrical member 207 connected to the back of the cylindrical member 205.

Figure 26:
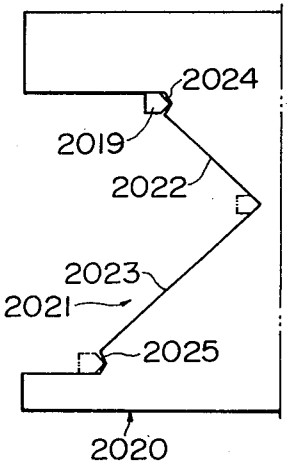
FIG. 26 is an expanded view showing essential portions of this embodiment.

On the outer circumference of the cylindrical member 207, there is fitted a cam cylinder 2020 having a similar cylindrical shape, which has its front end edge providing a cam 2021 such as shown in FIG. 26. FIG. 26 is an exploded view in which one portion of the cam cylinder 2020 is cut axially and it is exploded in a plane. The cam 2021 formed on the front end edge of the cam cylinder is formed generally into the shape of the letter "V", having first and second inclined edges 2022 and 2023 which are inclined in opposite directions. The first inclined edge 2022 is made slightly shorter than the second inclined edge 2023. Moreover, the first inclined edge is formed with a first retaining portion 2024 in the vicinity of its leading end, and the second inclined edge is formed with a second retaining portion 2025 in the vicinity of its leading end. The cam 2021 thus designed is followed by the projection 2019 of the sliding member 2017.

A supporting rod 2026 is integrally fitted from the back into the rear end of the cylindrical member 207. The supporting rod 2026 is formed with a flange 2027 at its rear end, and a spring $S_2$ which is made stronger than the spring $S_1$ is sandwiched between the flange and a washer 2028 applied to the rear end of the cam cylinder 2020. Moreover, a rear barrel member 2029 is fitted from the back over the outer circumference of the cam cylinder 2020 so that the cam cylinder 2020 and the rear barrel member 2029 may rotate integrally with each other.

FIG. 25 shows the sealed state in which the writing tip of the writing member is fitted in the accommodating hole 2014 of the seal member 2012 so that the seal ring 2016 seals the outer circumference of the reduced portion of the writing member 209, and in which the reduced portion 2013 of the seal member 2012 is fitted in the through hole 202 of the front barrel member. At this time, the projection 2019 of the sliding member 2017 is retained by the first retaining portion 2024 of the cam 2021 of the cam cylinder 2020. On the other hand, a force pushing the leading end portion of the writing member into the accommodating hole of the seal member 2012 is established by the force of the spring $S_2$, pushing forward the writing member, while compressing the spring $S_1$, through the washer 2028, the cam cylinder 2020 and the sliding member 2017. That is, the force of the spring $S_2$ pushes backwardly the seal member 2012 through the supporting rod 2026, the cylindrical member 207, the cylindrical member 205 and the front of barrel member 201. Incidentally, the air vent hole of the writing member is formed in front of the position at which the seal ring 2016 abuts in that state.

Figure 27:
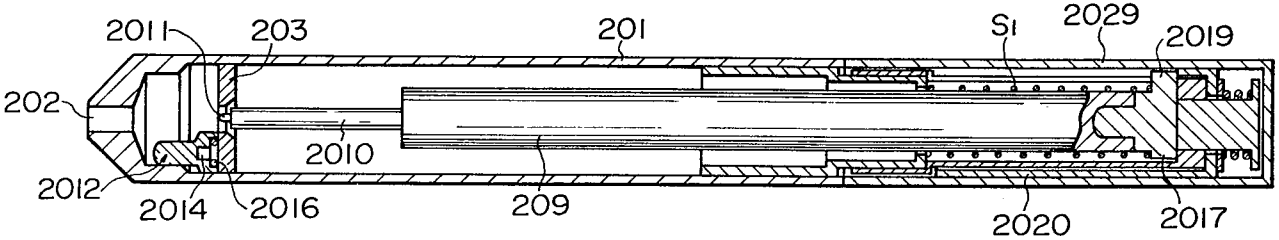
Figure 28:
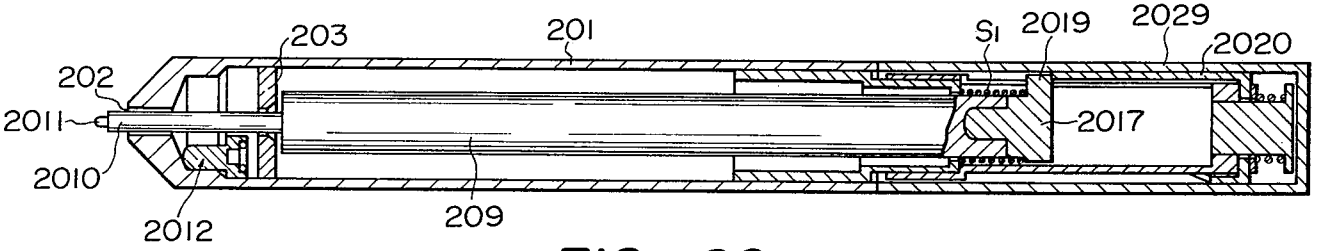

In order to switch from the sealed state to the writing state, the rear barrel member 2029 is turned clockwise relative to the front barrel member with the writing instrument being held in a horizontal or like position. The cam cylinder 2020 rotates integrally with the rear barrel member 2029, but the projection 2019 of the sliding member 2017 is disengaged from the first retaining portion 2024 of the cam 2021 of the cam cylinder so that it is continuously retracted along the first inclined edge 2022 by the force of the spring $S_1$. The writing member is continuously retracted integrally with the sliding member 2017, and the seal member is also continuously retracted as a result of which it holds onto the leading end portion of the reduced portion of the writing member by the elastic force of the seal ring 2016. However, after the rear end of the seal member abuts against the stopper 203, the seal member comes off of the reduced portion 2010 as the writing member is retracted. At this time, the state shown in FIG. 27 is established, in which the projection 2019 of the sliding member 2017 is retracted to the position where the first and second inclined edges 2022 and 2023 of the cam intersect and in which the writing member is at its rearmost position. If the turn of the rear barrel member 2029 is further continued, the projection 2019 is moved forwardly by the pushing action of the second inclined edges 2023 of the cam so that the sliding member and the writing member advance while compressing the spring $S_1$. When the projection 2019 advances to its foremost position so that it is retained by the second retaining portion 2025 of the cam, the writing state shown in FIG. 28 is established, in which the writing tip 2011 of the writing member 209 protrudes out of the through hole of the front barrel member. In order to change from the sealed state to the writing state, in other words, after the writing member is retracted so that the seal member is brought out of engagement with the leading end thereof, the turning operation of the rear barrel member is continued until the writing member advances so that its writing tip protrudes out of the through hole. Thus, a writing operation may be performed.

Figure 29:
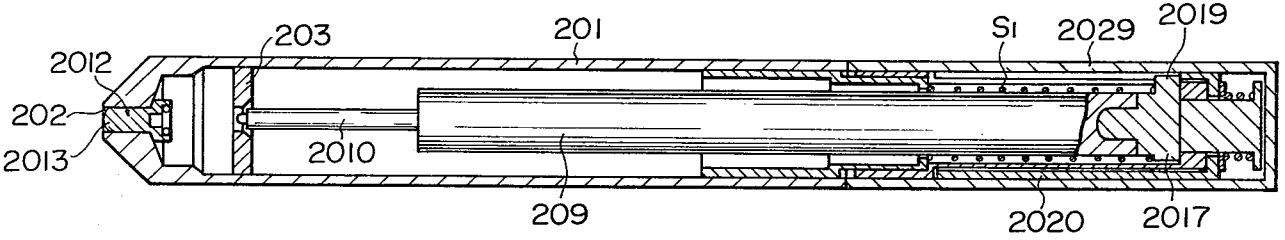

In order to change from the writing state to the sealed state, the rear barrel member is turned counter-clockwise with the leading end of the writing instrument being directed downwardly. The projection 2019 is disengaged from the second retaining portion 2025 to retract along the second inclined edge 2023, and the writing member is retracted together therewith until the leading end portion of the writing member does not obstruct the fall of the seal member. At this time, the seal member falls inside the leading end portion of the front barrel member until its reduced portion 2013 comes into the through hole. The writing member continues its retraction until it is retracted to its rearmost position, as shown in FIG. 29. If the rear barrel member is turned further counter-clockwise from this state, the projection 2019 is pushed forward by the first inclined edge 2022 until it is retained by the retaining portion 2024, thus restoring the sealed state shown in FIG. 25.

Figure 30:
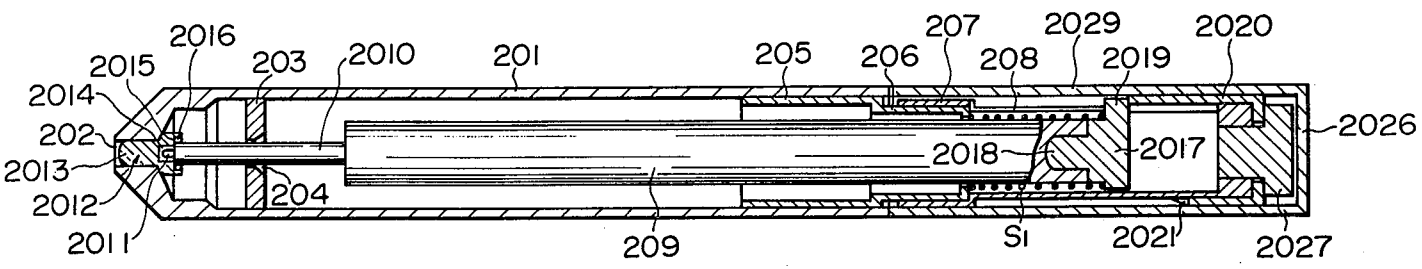
FIG. 30 is a sectional view showing a further embodiment.
Figure 31:
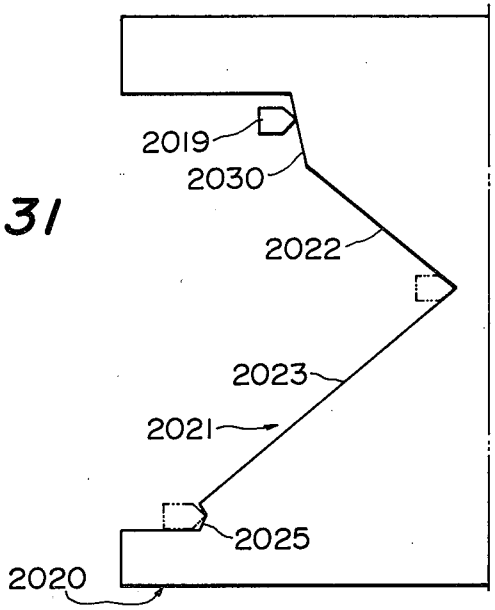
FIG. 31 is an expanded view showing essential portions of this embodiment.

Another embodiment of the present device will be described with reference to FIGS. 30 and 31. In the previous embodiment, the spring $S_2$ was used to establish the force to bring the leading end portion of the writing member into the accommodating hole of the seal member 2012 in the sealed state. In this embodiment, on the contrary, the use of the spring $S_2$ is omitted. The present embodiment is identical to the prior embodiment except that the spring $S_2$ is not used, but the shape of the cam 2021 of the cam cylinder 2020 is modified, as shown in FIG. 31. Specifically, the cam 2021 is not formed with the first retaining portion 2024 but instead with a third inclined edge 2030 which has a gentle slope. In order to change from the writing state to the sealed state, the rear barrel member 2029 is further turned slightly against resistance, after the leading end portion of the writing member has been fitted in the accommodating hole of the seal member, to thereby snugly fit the leading end portion of the writing member therein.

Figure 32:
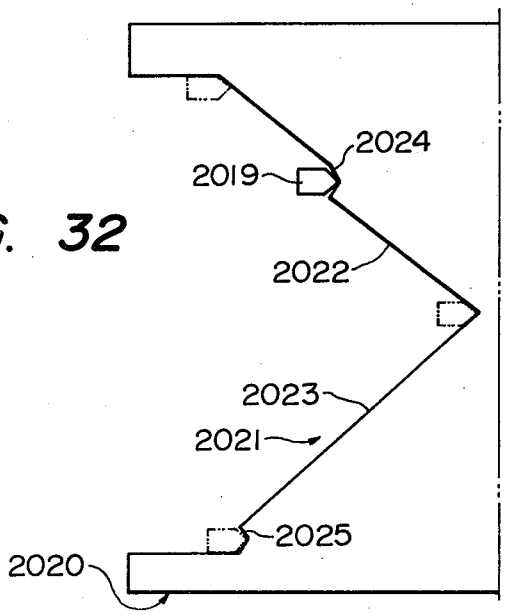
FIG. 32 is an expanded view showing essential portions of another embodiment.

A further embodiment of the present device will now be described with reference to FIG. 32. This embodiment is devised to confirm to the user whether or not the writing tip is reliably sealed. The first inclined edge 2022 of the cam 2021 is rather elongated and is formed midway with a first retaining portion 2024. In the sealed state, the projection 2019 is retained by the first retaining portion 2024 to thereby negate any further turn in the same direction. In case the writing tip is not sealed, the projection 2019 is further forced onto the first inclined edge 2022 so that the writing member advances to protrude from the leading end of the front barrel member. Therefore, if the writing tip 2011 projects to reveal that it is not sealed, the writing member is returned to its rearmost position, and again moved forward with the leading end of the writing instrument being directed downwardly. If the projection 2019 cannot be turned further in the same direction after it has been retained by the first retaining portion 2024, it can be concluded that the sealed state is established.

Figure 33:
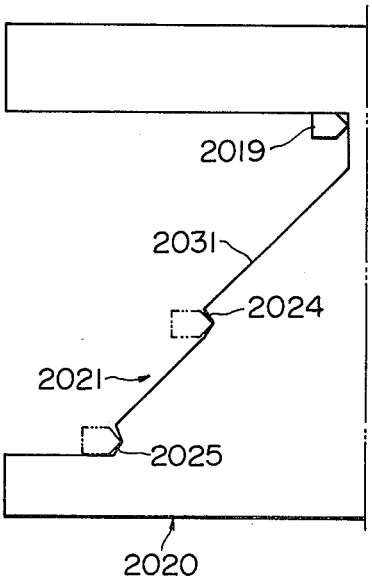
FIG. 33 is an expanded view showing essential portions of a still further embodiment.

A further modification of the present device is shown in FIG. 33. In this embodiment, the first inclined edge 2022 and the second inclined edge 2023 are not formed, but rather one long inclined edge 2031 is provided and is formed with the first retaining portion 2024 and the second retaining portion 2025 midway in and at the leading end thereof, respectively. When it is intended to change from the sealed state to the writing state, the rear barrel member is turned counter-clockwise until it is stopped, and then is turned fully clockwise. When changing from the writing state to the sealed state, on the other hand, the rear barrel member 2029 is turned fully counter-clockwise and then midway clockwise.

Figure 34:
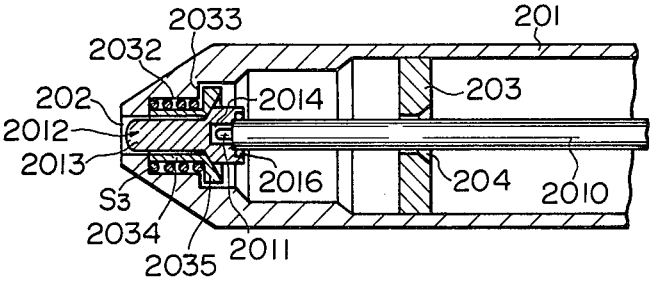
FIGS. 34 and 35 are sectional views of portions explaining the operation of another embodiment.
Figure 35:
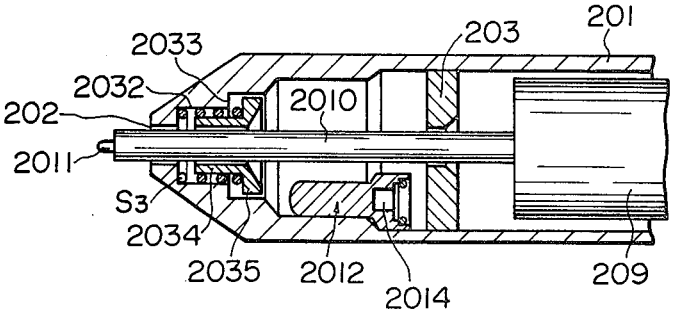

Next, another embodiment of the present device will be described with reference to FIGS. 34 and 35. In this embodiment, a different device is adopted to establish the force bringing the leading end portion of the writing member into the accommodating hole of the seal member. Specifically, the leading end of the inside of the front member 201 is formed with a reduced portion 2032 having a small diameter, and a stepped portion 2033 is formed at the back of the reduced portion 2032. In the reduced portion 2032, there is fitted a sliding cylinder 2034, which has its rear end formed with a flange 2035 to abut the stepped portion 2033. Moreover, a spring $S_3$ is fitted in the reduced portion 2032 so that it may not easily come out, and the inner circumference of the spring is likewise fitted about the outer circumference of the sliding cylinder 2034 so that the cylinder may not easily come out. As a result, the reduced portion 2013 of the seal member is held in the sliding cylinder 2034. In the sealed state, as is apparent from FIG. 34, the force directed to push the seal member onto the leading end portion of the writing member is established by biasing the seal member backward via the sliding cylinder 2034 by the action of the spring $S_3$.

Figure 36:
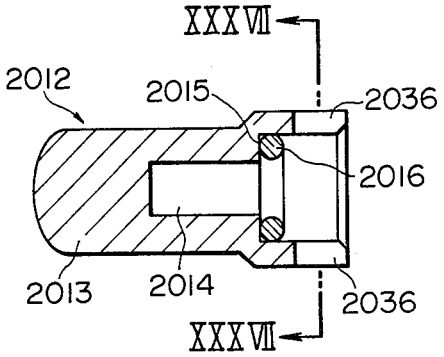
FIG. 36 is a sectional view showing essential portions of a further embodiment.
Figure 37:
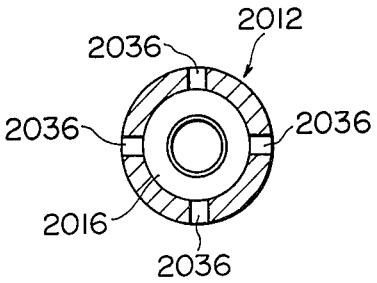
FIG. 37 is a section taken along line XXXVII—XXXVII of FIG. 36.

A further embodiment of the present device will now be described with reference to FIGS. 36 and 37. In foregoing embodiments, in the procedure for changing from the sealed state to the writing state, the writing member is retracted, while carrying the seal member on its leading end, until the seal member abuts against a stopper 203. At this time, if the rear end face of the seal member is blotted with the ink of the writing member, a capillary phenomenon takes place when the rear end face of the seal member contacts with the front end face of the stopper 203, to thereby possibly cause the seal member 2012 to stick to the stopper and thus fail to fall down. In this embodiment, however, the seal member is formed at its rear end with four notches 2036, so that such possibility may be obviated.

Figure 38:
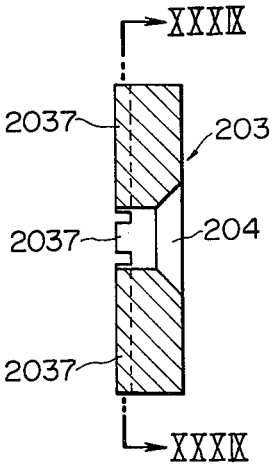
FIG. 38 is a sectional view showing essential portions of yet another embodiment.
Figure 39:
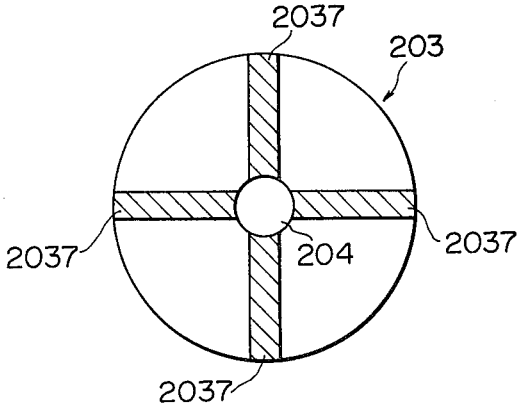
FIG. 39 is a section taken along line XXXIX—XXXIX of FIG. 38.

In an embodiment shown in FIGS. 38 and 39, on the other hand, similar effects can be obtained if four ridges 2037 are formed in the form of a cross on the stopper 203.

Figure 40:
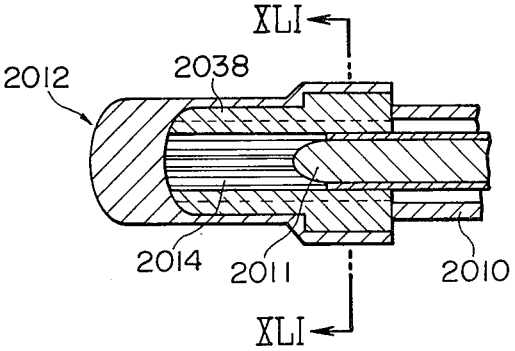
FIG. 40 is a sectional view showing portions of a further modification.
Figure 41:
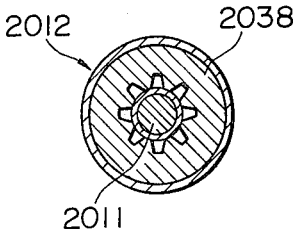
FIG. 41 is a section taken along line XLI—XLI of FIG. 40.
Figure 42:
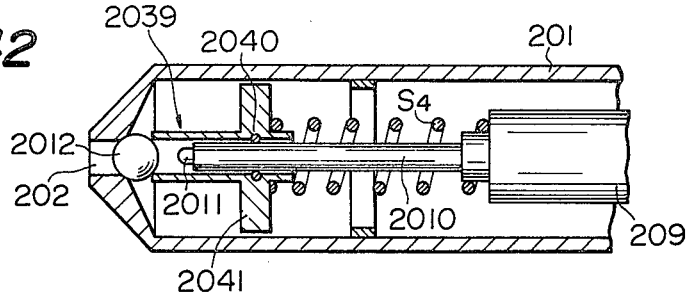
FIGS. 42, 43, 44 and 45 are sectional views of essential portions for explaining the operation of an additional embodiment, respectively.
Figure 43:
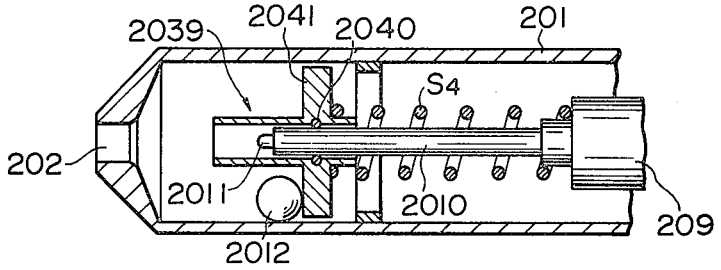
Figure 44:
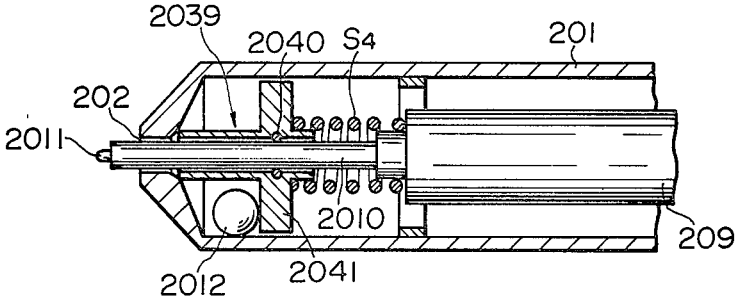
Figure 45:
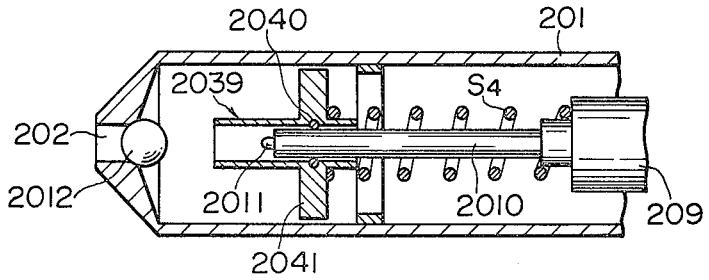

In an embodiment shown in FIGS. 40 and 41, moreover, an elastic member 2038 may be fitted in the seal member and formed on its inner face with axial roughness. In this modification, the writing tip of the writing member is elastically held in the elastic member 2038 in the sealed state, as shown in FIG. 40. It is, therefore, unnecessary to provide the seal ring 2016 used in the respective foregoing embodiments. If the reduced portion 2010 is formed with the air vent hole at its leading end, furthermore, the seal can be effected at the front end face of the reduced portion 2010 without plugging the air vent hole.

Another embodiment of the present device will now be described with reference to FIGS. 42 to 45. In this embodiment, the seal member is formed as a ball, and a seal cylinder 2039 is fitted about the outer circumference of the reduced portion of the writing member 209. A seal ring 2040 is fitted in the inner circumference of the seal cylinder 2039 to thereby seal the seal cylinder and the reduced portion 2010. The seal cylinder is formed with a flange 2041 on its outer circumference, and a spring $S_4$ is sandwiched between the flange and the writing member 209 to thereby bias the seal sylinder 2039 forwardly. The seal of the writing tip 2011 is effected between the contact between the seal ball 2012 and the seal cylinder 2039 and the contact between the seal ring 2040 and the reduced portion 2010. As is apparent from FIG. 42, the design is made such that the writing tip 2011 does not abut against the seal member 2012 in the sealed state. The operations of this embodiment will be apparent from FIGS. 42 to 45. In this embodiment, moreover, a seal ring may be fitted on the inner wall of the front barrel member 201 so that the clearance between the front barrel member and the writing member may be sealed by that seal ring, and the seal of the writing tip may be effected by sealing the clearance between the seal member 2012 and the inner wall of the rear end of the through hole.

A further embodiment of the present device will be described with reference to FIGS. 46 to 48. The leading end of the inside of the front barrel member is formed with an arcuate recess 2042 which is formed with the through hole extending forward from the center thereof. In the vicinity of the leading end of the inside of the front barrel member, there is fixedly press-fitted a cylindrical member which is shown in a partially cutaway perspective view in FIG. 47. The front end of the cylindrical member 2043 is formed at one portion with a hinge 2044, through which the seal member 2012 is hinged. The hinge is made slender, and the seal member is thus operative to swing easily back and forth through a portion of the hinge. Moreover, the cylindrical member, the hinge and the seal member are integrally molded of plastic. The seal member is curved so that it can snugly fit in the recess 2042 formed in the leading end of the front barrel member.

Figure 46:
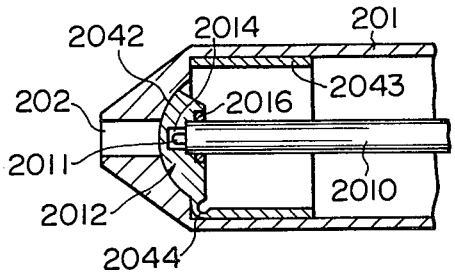
FIGS. 46 and 48 are sectional views for explaining the operation of another embodiment, respectively.

FIG. 46 shows the sealed state, with the end of the writing member being received in the stepped internal space of the member 2012. The rear barrel member 2029 is turned to retract the writing member 209 with the hinge 2044 being directed downwardly. Then, the frictional force acting between the outer circumference of the reduced portion 2010 and a seal ring 2016 causes the seal member 2012 to be pulled down, to pull the seal member backward, as shown in FIG. 48.

Figure 50:
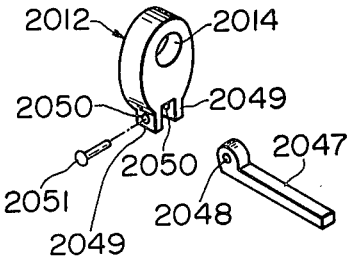
FIGS. 50 and 50*a* are expanded perspective views showing a sealing member.
Figure 50A:
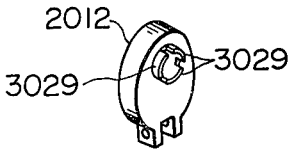
Figure 49:
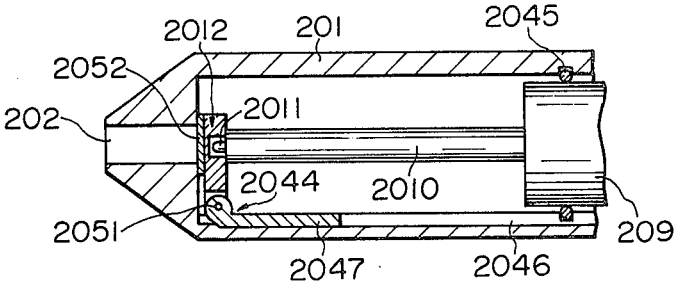
FIGS. 49 and 51 are sectional views for explaining the operation of a still further modification, respectively.
Figure 51:
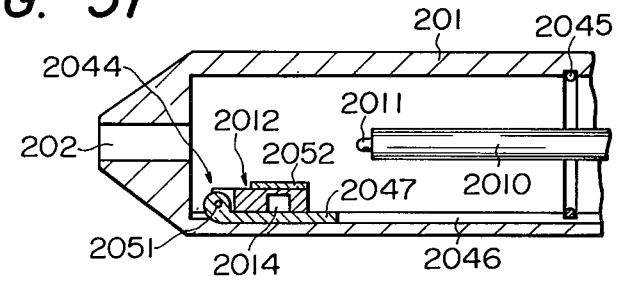

In an embodiment shown in FIGS. 49 to 51, a seal ring 2045 made of an elastic material such as rubber is fitted on the inner circumference of the front barrel member slightly at the back of the leading end of the same. The seal ring 2045 seals the outer circumference of the writing member in at least the sealed state. Moreover, the front barrel member is formed in its inner wall with an axial groove 2046, in which a supporting member 2047 shown in FIG. 50 is fit. This supporting member 2047 is formed generally as a rectangular rod which has a width such as is snugly fitted in the groove 2046. The front end of the supporting member is slightly raised to form an upward projection, which is formed with a transverse hole 2048. The seal member 2012 is shown in FIG. 50. The seal member is generally formed into an elliptical shape and is formed at its lower end with two legs 2049 which extend downwardly at a spacing equal to the width of the supporting member 2047, and which are formed with transverse holes 2050, respectively. Moreover, the protruding front end of the supporting member is fit in the gap between the legs 2049, and the holes 2050 of the legs and the hole 2048 of the supporting member are aligned. Then, a pin 2051 is inserted into holes 2048, 2050. The inserted portion of the pin acts as a hinge 2044 so that the seal member may swing therearound. As shown in FIG. 49, moreover, a seal plate 2052 made of an elastic material such as rubber is adhered to the back of the seal member, or may take the form of a ring fixed about the through hole. In this embodiment, a seal ring 2016 is not used in the accommodating hole formed in the seal member. After the seal member and the supporting member 2047 have been connected by means of the pin 2051, the supporting member 2047 is fitted in the groove 2046 of the front barrel portion and is brought forward to the foremost position in the front barrel member, thus completing the installation operation. In the sealed state shown in FIG. 49, the seal member is held upright and is pushed by the writing member onto the inner wall of the leading end of the front barrel member so that the seal plate 2052 of elastic material adhered to the front face of the seal member plugs the through hole. In the sealed state, seals are effected at two locations: the seal plate 2052 plugs the through hole, and the seal ring 2045 seals the outer circumference of the writing member. Thus, the air vent hole formed in the writing member may be positioned in front of the position at which the seal ring 2045 is located. The operations of the embodiment will be apparent from FIGS. 49 and 51. In the preceding embodiment, since a seal ring is not used in the accommodating hole of the seal member, the force between the writing member and the seal tending to pull back to the seal is not established, to make it probable that the seal cannot be pulled down. However, the modification shown in FIG. 50*a* is devised to make it easy to pull down the seal member. Specifically, the seal is formed on its rear side with elastic member 3029 which extend backward around the accommodating hole. As a result, in the sealed state, the reduced portion of the writing member is snugly fit into the elastic member 3029, so that it is elastically supported by the latter. Thus, the force for pulling the seal is generated by the frictional force established between the elastic member 3029 and the reduced portion. According to this embodiment, the seal is raised to an extent corresponding to the length of the elastic members 3029 when it is pulled down. It is necessary that the stopper be disengaged from the back position of the through hole in spite of that fact.

Incidentally, it is not always necessary that the force for pulling down the seal by established when the sealed state is changed to the writing state, as the device may be devised such that the stopper naturally swings down when the writing member is retracted. For example, it is sufficient that the center of gravity of the seal be located at an upper back position, or that the seal take on a slightly inclined position at the beginning.

On the other hand, many modifications can be adopted as to the shape, material, attaching method and so on of the seal. If the leading end portion of the writing instrument is made transparent, the motion of the seal can conveniently be observed from the outside to confirm the sealed state.

In the embodiments of FIGS. 25 to 51, the writing member is moved back and forth by the action of a cam mechanism when the rear barrel member is turned. The transmission mechanism for moving the writing member back and forth can be any of several conventional devices such as a mechanism using a helical system or a screw driving system. The mounting position of such transmission mechanism may also be conventionally selected. In the writing instrument according to the present device, the barrel is divided into a front barrel member 201 and the rear barrel member 2029, which are made rotatable relative to each other. In any event, it is sufficient that the writing member be moved back and forth when those two portions are turned relative to one another.

As is apparent from the foregoing description, in the writing instrument according to the embodiments of FIGS. 25 to 51, the front and rear barrel members constituting the barrel are turned relative to each other with the writing instrument being held in a horizontal or like position. Then, the transmission mechanism, which is interposed between the barrel and the writing member so as to move the writing member back and forth, is actuated to retract the writing member. At this time, the seal member, which has plugged the through hole formed at the leading end of the front barrel member, is disengaged from the rear position of the through hole. Now, if the writing member is again moved forward by turning the barrel, the writing tip at the leading end of the writing member protrudes from the through hole for writing. If the barrel is then turned with the leading end of the writing instrument being directed downwardly, the writing member is retracted so that the seal member plugs the through hole, and the writing member again advances to seal the writing tip. Thus, the operations for establishing the writing state and the sealed state are simple. All that is required for constructing the leading end portion of the front barrel member is that the through hole be formed at the center of the leading end and that the seal member be disposed just back of the through hole. As a result, the leading end portion of the front barrel member can be formed in a converging sharp shape for excellent design. Moreover, if the leading end of the writing member is made slender, the through hole of the front barrel member can be made so small as to allow only the leading end portion to pass therethrough. As a result, since the seal member can be so small as to just plug the through hole, the writing instrument can be made slender as a whole, and its leading end portion can be designed to be sharp.

Figure 47:
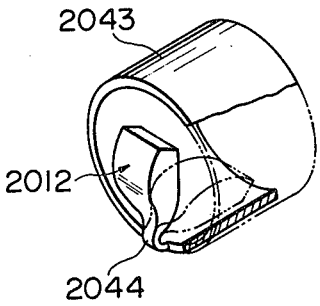
FIG. 47 is a partially cut-away perspective view showing a portion of this embodiment.
Figure 48:
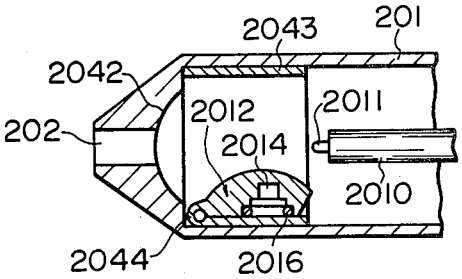

FIGS. 52 to 55 show a modification of the device of FIGS. 46 to 48. More specifically, the actuating mechanism is altered from a cam/rotary type to a linear type.

A disc-shaped connecting member 3011 is formed with two diametrically opposite legs 3012, which are fixedly attached to the rear end of the barrel 301. On the other hand, the sliding cylinder is formed in the vicinity of its rear end with two diametrically opposite slits 3013 which extend in the axial direction. The legs 3012 of the connecting member are fit in the slits 3013, respectively. Moroever, the connecting member is formed at its front side center with a male thread member 3014, which extends forwardly, and at its rear side center with a column 3015 which extends backwardly.

The writing member is fit in the sliding cylinder, and is formed at its rear end with a recess which is internally threaded, to connect to the connecting member 3011.

When the writing member is to be fitted in the accommodating hole of the stopper 2012, the front end of its reduced portion abuts the stepped portion of the accommodating hole. At this time, the seal ring seals the outer circumference of the reduced portion. Also, the member 2012 is brought away from its engagement with the back of the through hole at the front end of the sliding cylinder when it swings to fall down.

A spring 3019 is fitted from the back on the rear column 3015 of the connecting member 3011 so that it does not easily come out. Moreover, a cap 3020 is attached, while compressing that spring, and is screwed onto the rear end of the sliding cylinder.

Figure 52:
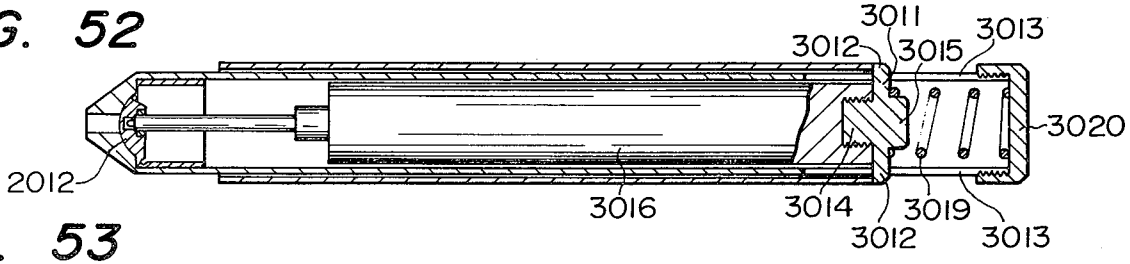
FIGS. 52, 53, 54 and 55 are views similar to FIGS. 46, 47, 48 and 49, showing an alternative actuating mechanism.

FIG. 52 shows the sealed state in which the writing tip of the writing member is fitted in the accommodating hole of the seal member so that the seal ring thereof seals the outer circumference of the reduced portion of the writing member. The sealed state is ensured as the spring 3019 biases the sliding cylinder backward relative to the barrel. The air vent hole of the writing member is formed in this state in front of the position at which the seal ring abuts against the reduced portion.

Figure 53:
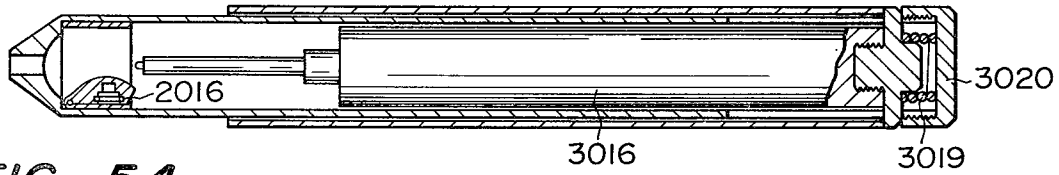
Figure 54:
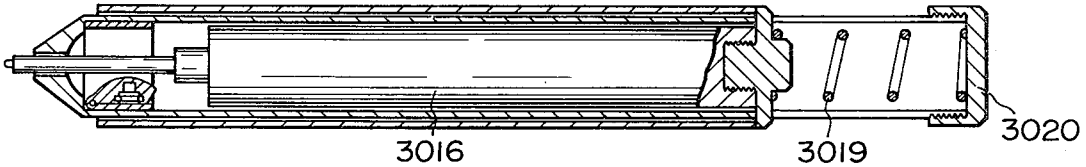

When the sealed state is to be changed to the writing state, the cap 3020 is depressed with the writing instrument being held in a horizontal or like position and with the hinge connecting the cylindrical member and the seal 2012 being directed downwardly. The sliding cylinder advances, while compressing the spring, and the seal cap advances together with the writing tip until the writing member comes out of the accommodating hole. Since a frictional force is exerted between the outer circumference of the reduced portion of the writing member and the seal ring 2016, a force is effective to pull down the member 2012 as shown in FIG. 53. In this state, the seal member leaves the back position of the through hole of the sliding cylinder and the front position of the reduced portion of the writing member. Now, if the pushing action on the cap 3020 is released, the sliding cylinder is retracted by the force of the spring 3019 so that the writing tip protrudes out of the front end of the sliding cylinder, as shown in FIG. 54.

Figure 55:
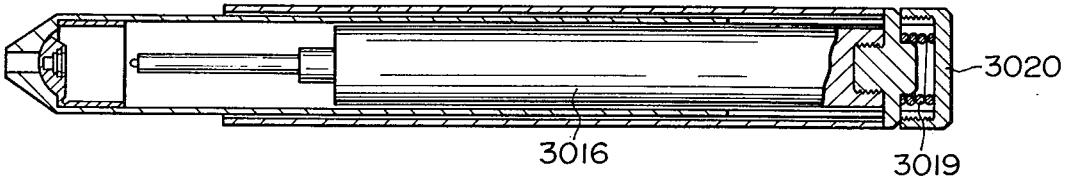

In order to return to the sealed state, the cap 3020 is depressed with the leading end of the writing member being directed downwardly. Then, the sliding cylinder advances so that the member 2012, having fallen down backward, swings forward about the hinge by its own weight until it is again fitted in the recess of the sliding cylinder, as shown in FIG. 55. Now, if the pushing action of the cap is released, the sliding cylinder is retracted by the force of the spring to thereby restore the sealed state of FIG. 52, in which the writing tip is fitted in the accommodating hole. The embodiment of FIGS. 49 to 51 may also employ the actuating mechanism of FIGS. 52 to 55.

FIGS. 56 to 60 represent a further embodiment similar to that previously described in connection with FIGS. 42 to 45. A seal cylinder 4010 is fitted on the outer circumference of the front half of the reduced portion 408. Between the rear end of the seal cylinder 4010 and the stepped portion 407 of the writing member, there is sandwiched a spring $S_1$, by which the seal cylinder 4010 is biased forwardly. A seal ring 4011 is fitted in the inner circumference in the vicinity of the rear end of the seal cylinder 4010 to thereby seal the clearance between the seal cylinder and the reduced portion. In front of the seal cylinder, moreover, there is arranged the seal ball 4012, which has a diameter slightly larger than the internal diameters of the through hole and the seal cylinder 4010. The actuating mechanism is identical to that previously discussed in connection with FIGS. 9 to 11, and thus will not be discussed in detail.

Between the disc 4014 fitted in the barrel and the depression member 4017, there is sandwiched a spring $S_2$, by which the sliding cylinder 402 and so on are biased backwards relative to the barrel. Incidentally, the spring $S_2$ is made to have a stronger force than that of the spring $S_1$ which is sandwiched between the seal cylinder 4010 and the writing member.

Figure 56:
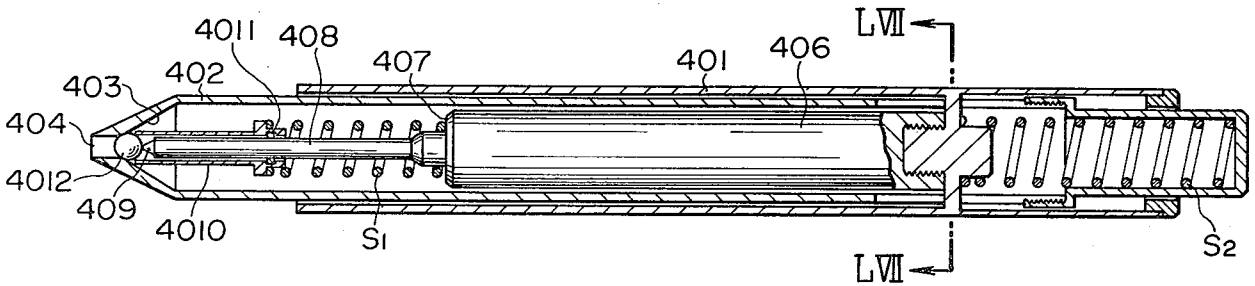
FIG. 56 is a longitudinal section showing another embodiment of the present device.
Figure 57:
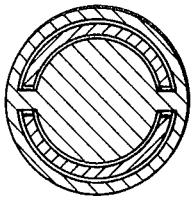
FIG. 57 is a section taken along line XVII—LVII of FIG. 56.

Moreover, FIG. 56 shows the sealed state in which the seal ball 4012 is held between the through hole of the sliding cylinder and the seal cylinder fitted on the reduced portion of the writing member to thereby seal the inside of the seal cylinder 4010. Since, at this time, the spring $S_2$ biases the sliding cylinder backward through the member 4017, the seal ball is pushed and biased by the inner wall of the leading end portion of the sliding cylinder so that it abuts against the writing tip of the writing member. Moreover, the leading end of the seal cylinder 4010 is pushed onto the seal ball by the force of the spring $S_1$ biasing the seal cylinder forward so that a seal is achieved between the seal ball and the seal cylinder. The seal between the seal cylinder and the reduced portion 408 is effected by the seal ring 4011 which is fitted in the inner circumference in the vicinity of the rear end of the seal cylinder. Therefore, the air vent hole to be formed in the reduced portion may be positioned in front of the seal ring 4011 in the sealed state shown in FIG. 56.

Figure 58:
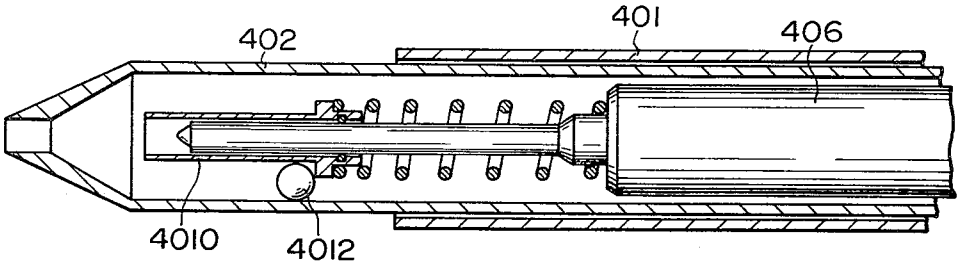
FIGS. 58, 59 and 60 are longitudinal sections of essential portions for explaining the operation of the embodiment of FIG. 56, respectively.
Figure 59:
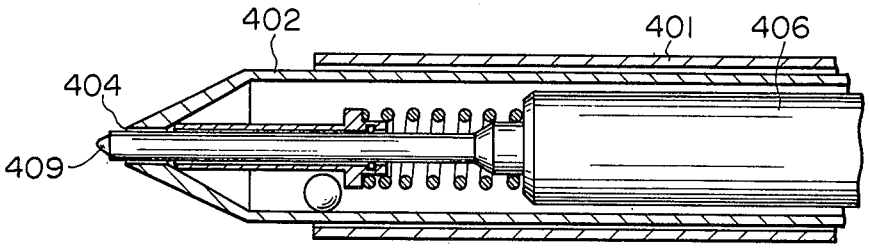

In order to bring the writing instrument thus far described into the writing state, the member 4017 is depressed with the writing instrument being held in a substantially horizontal position. The sliding cylinder thus advances while compressing the spring $S_2$. On the other hand, the seal cylinder 4010 is slightly moved forward by the force of the spring $S_1$. However, when the spring $S_1$ extends to its full stroke, the advance of the seal cylinder 4010 stops, while the sliding cylinder 402 further advances so that the seal ball, which has been held between the inner wall of the leading end portion of the sliding cylinder and the seal cylinder, is set free to fall, as shown in FIG. 58. Now, if the pushing action on the member 4017 is ceased, the member and the sliding cylinder are retracted, while compressing the spring $S_1$, by the force of the spring $S_2$, and the seal cylinder is pushed and retracted by the inner wall of the leading end portion of the sliding cylinder so that the writing tip of the writing member protrudes out of the through hole of the sliding cylinder as shown in FIG. 59. The writing operation is accomplished in this state.

Figure 60:
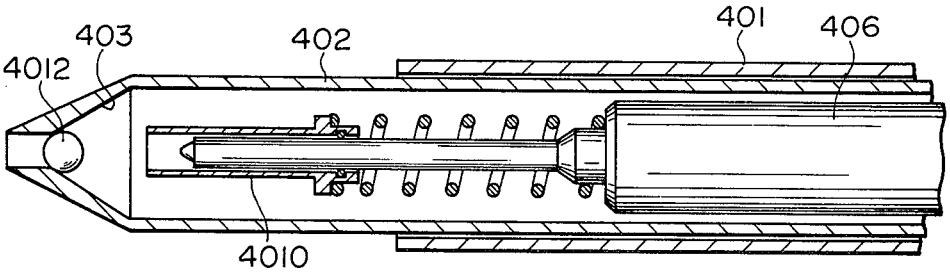

Next, to return to the accommodated state, the member 4017 is operated with the leading end of the writing instrument being directed downwardly. Thus, the sliding cylinder advances so that the seal ball falls down along the conical wall of the leading end portion of the sliding cylinder to the front thereof to plug the through hole 404, as shown in FIG. 60. Now, if the pushing action on the member 4017 is released, the sliding cylinder is retracted by the force of the spring $S_2$ so that the seal ball is also retracted to abut against the leading ends of the seal cylinder 4010 and the writing tip 409 to thereby restore the state of FIG. 56.

Another embodiment of this device will be described with reference to FIGS. 61 to 64. The foregoing embodiment uses a sliding seal cylinder 4010 and a spring $S_1$ so that its construction is rather complicated. On the contrary, this embodiment can have its construction rather simplified by fixing the seal cylinder 4010 to the sliding cylinder 402 so that the spring $S_1$ is omitted. More specifically, the seal cylinder is fixed to the inner wall in the vicinity of the leading end of the writing member 406 so that the reduced portion 408 of the writing member can move back and forth in the seal cylinder. The remaining construction is similar to that of the preceding embodiment, and the operation thereof will be apparent from FIGS. 61 to 64. Incidentally, it is convenient to make the seal cylinder as long as possible so as to correctly guide the reduced portion of the writing member.

Figure 61:
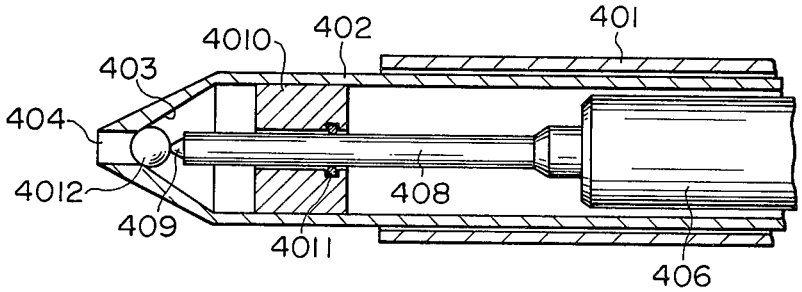
FIGS. 61, 62, 63 and 64 are longitudinal sections of essential portions for explaining the operation of a further embodiment, respectively; and, finally.
Figure 62:
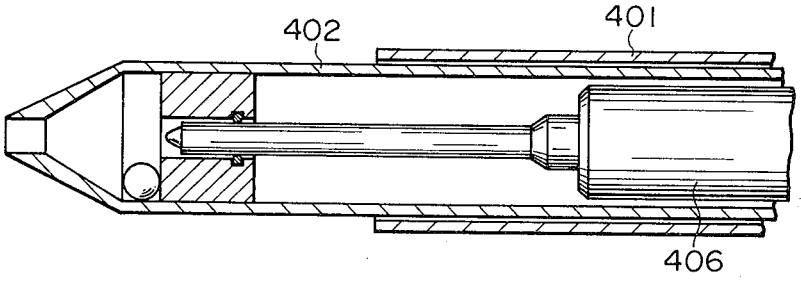
Figure 63:
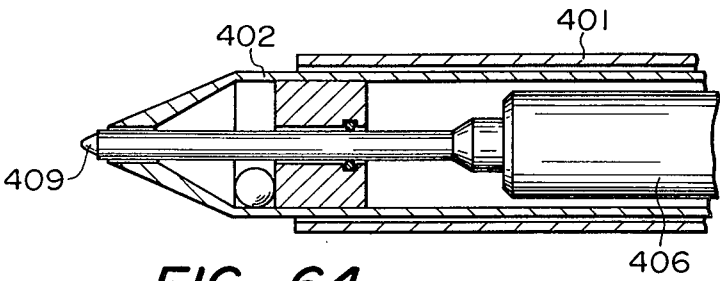
Figure 64:
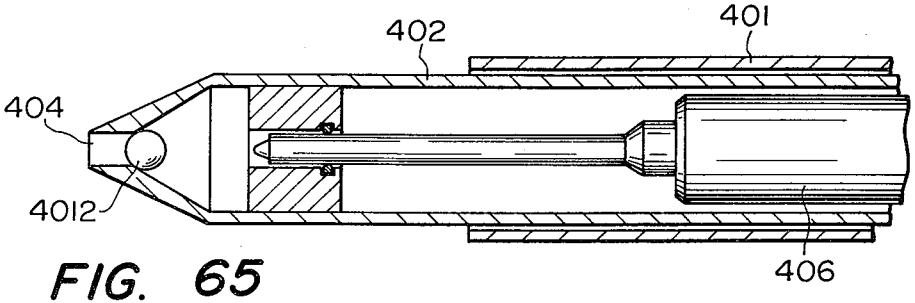

In the sealed state shown in FIG. 61, moreover, seals are effected between the seal ball and the through hole of the sliding cylinder and between the reduced portion of the writing member and the seal ring 4011.

Next, a further similar embodiment of the present device will be described with reference to FIGS. 65 to 68. The foregoing embodiments disclose a writing instrument which allows the leading end of the writing tip of the writing member to abut against the seal ball whereby that abutment takes place in the sealed state. On the contrary, the present embodiment is devised so that the leading end of the writing tip may not abut against the seal ball in the sealed state. The barrel is divided into two halves, i.e., a front barrel member 4019 and a rear barrel member 4020, which are connected to provide a single barrel by fitting the legs 4013 of the disc 4014 in-between and screwing one into the other. The front half of the front barrel member 4019 is formed in its inner wall with a cam wall 4021, which is formed with deeper and shallower grooves extending in the axial direction and which is formed with an inclined edge at its front end. In the cam wall 4021, there is fitted a cam ring 4022 which is formed with a ridge on its outer circumference fitted in the deeper groove of the cam wall 4021 so that the cam ring is allowed to move back and forth but is prohibited from rotation. The cam ring 4022 is formed with an inclined edge at its front end. Moreover, the cam ring is integrally attached to the outer circumference of the sliding cylinder 402. The cam ring may be loosely fitted separately of the sliding cylinder so that the sliding cylinder at the back thereof may be formed with a projection or a ridge on its outer circumference. A rotary cam 4023 is arranged in front of the cam ring 4022 and is formed on its outer circumference with a ridge which is fitted in the shallower groove of the cam wall 4021 so that the rotary cam 4023 is allowed to move back and forth on the cam wall and to rotate when it advances out of engagement with the cam wall. The rotary cam 4023 is also formed with an inclined edge at its rear end. A forward and backward mechanism composed of the cam wall 4021, the cam ring 4022 and the rotary cam 4023 thus far described is usually used according to the prior art in a writing instrument such as the ball-point pen or mechanical pencil of the so-called "double knock type".

From the rear end of the seal cylinder 4010, moreover, there extend toward the outer circumference two legs 4024 which protrude to the outside through the slits 405 of the sliding cylinder 402 such that they are positioned in front of the rotary cam 4023. A ring 4025 is fitted in the leading end portion of the sliding cylinder just at the bottom of the position formed with the conical wall 403 so that is is fixed in the sliding cylinder. A spring $S_3$ is sandwiched between the ring 4025 and the legs 4024 of the seal cylinder to thereby bias the seal cylinder 4010 backwards. The spring $S_3$ has a weaker force than the spring $S_2$, which is made operative to bias the sliding cylinder backwardly. A ring 4026 is screwed into the front end of the front barrel member 4019 to thereby prevent the legs 4024 of the seal cylinder 4010 from coming out.

Figure 65:
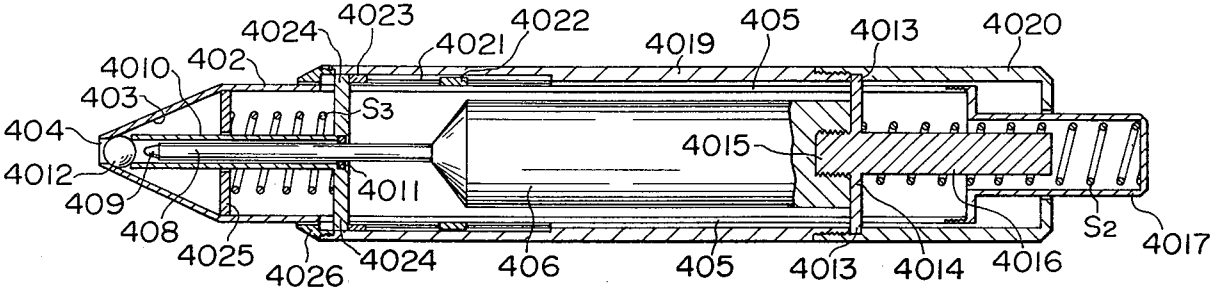
FIGS. 65, 66, 67 and 68 are longitudinal sections explaining the operation of a still further embodiment, respectively.

Moreover, FIG. 65 shows the sealed state, in which the rotary cam 4023 is in its advanced position to hold the seal cylinder at its advanced position and in which the seal ball is held by the force of the spring $S_2$ between the inner wall of the leading end of the sliding cylinder and the leading end of the seal cylinder to thereby seal the leading end of the seal cylinder. Incidentally, the length of the reduced portion 408 is so adjusted at this time that the writing tip of the writing member is kept away from contact with the seal ball.

Figure 66:
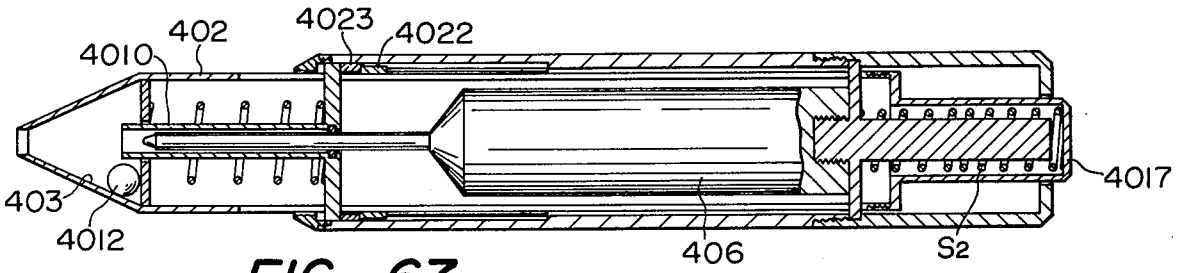
Figure 67:
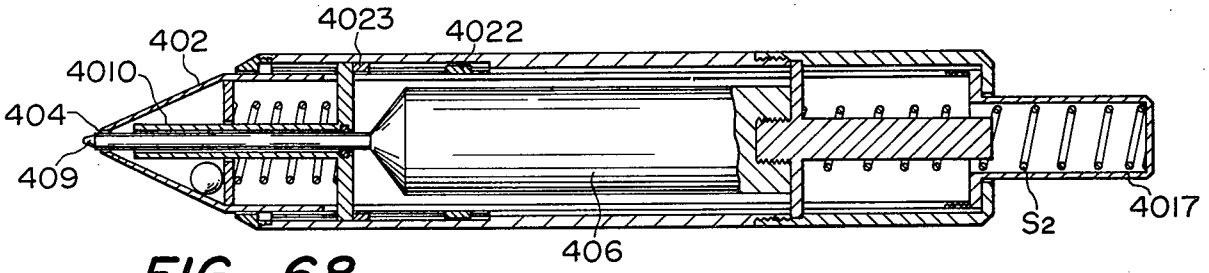
Figure 68:
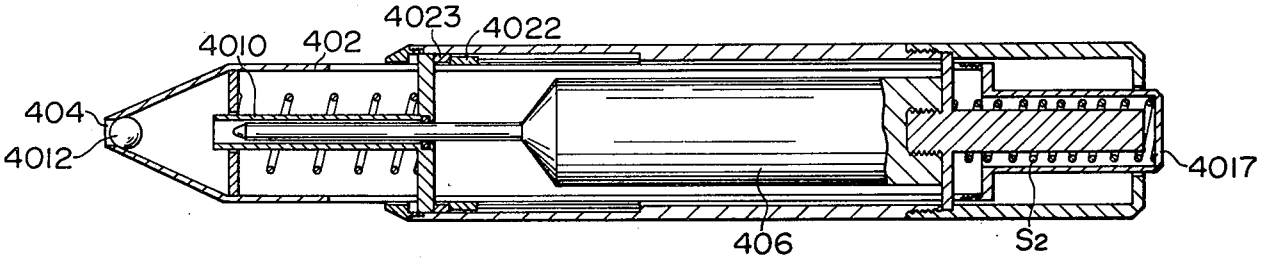

In order to change this state into the writing state, the member 4017 is operated with the writing instrument being held substantially in a horizontal position. Then, the member 4017 and the sliding cylinder are moved forward, while compressing the spring $S_2$, so that the seal ball, which has been held between the inner wall of the leading end portion of the sliding cylinder and the leading end of the seal cylinder, is free to fall down along the conical wall of the leading end of the sliding cylinder away from the front position of the seal cylinder, as shown in FIG. 66. At this time, the cam ring 4022 advancing together with the sliding cylinder slightly moves the rotary cam 4023 forwardly so that the rotary cam is rotated into a state in which it can be retracted. Now, if the pushing action of the member 4017 is released, the sliding cylinder is retracted, while compressing the spring $S_3$, until the stepped portion of the cap 4017 abuts the stepped portion of the rear barrel member 4020 so that the writing tip of the writing member protrudes out of the through hole of the sliding cylinder to thereby achieve the writing state shown in FIG. 67. When the sealed state is to be restored, however, the state shown in FIG. 68 is achieved by operating the member 4017 while the leading end of the writing instrument is directed downward. If the pushing action of the member 4017 is released, the rotary cam is left at the advance position to hold the seal cylinder at the advance position, and the sliding cylinder and the seal ball are retracted to restore the sealed state shown in FIG. 65.

Although the present device has been disclosed by several embodiments, it should not be limited to those embodiments. For example, there has been disclosed a construction in which the seal cylinder is formed in its inner wall with means for fitting the seal ring 4011 therein. However, the seal ring may be disposed on the outer circumference of the leading end portion of the writing member at a portion which is positioned within the seal cylinder when in the sealed state. On the other hand, the mounting method of the seal ring is arbitrary. Moreover, the seal ball may be made of an arbitrary material. In case the seal ball is made of a hard material, it is recommended to attach an elastic member such as an O-ring to the leading end of the seal cylinder or to make the seal cylinder itself of an elastic material. In case the seal cylinder is made of an elastic material, on the other hand, the seal ring may be dispensed with by forming a rib on the inner circumference of the seal cylinder. Likewise, the seal ball may be covered with an elastic film or made of an elastic material such as rubber. In the embodiment of FIGS. 61 to 64, in case the seal ball is made of a hard material, an elastic member such as an O-ring may be mounted in that portion of the through hole of the sliding cylinder, against which the seal ball abuts. For the forward and backward mechanism which has been used in the last embodiment for retaining the seal cylinder at the advance position or for retracting the same, there can be adopted an conventional mechanisms other than that disclosed. In addition, the design of the many portions can be changed.

What is claimed is:

1. A writing instrument comprising; a writing member fitted in a barrel such that a leading end portion of said writing instrument and said writing member can be moved axially relative to each other; the leading end portion of said writing instrument being formed with a through hole, an accommodating chamber at the back of said through hole, a free-standing gravity actuated seal cap accommodated in said accommodating chamber, said seal cap being movable to a position in which it does not block the advance of said writing member relative to the leading end portion of said writing instrument, or to a position behind said through hole in which it is fitted on a writing tip of said writing member while blocking the advance of said writing member relative to the leading end portion of said writing instrument.

2. A writing instrument as claimed in claim 1, further comprising means for removing said seal cap from said writing member when said writing member is retracted relative to said end portion of said writing instrument.

3. A writing instrument as claimed in claim 2, said removing means comprising an abutment engaged by said seal cap including an aperture for passing only said writing member.

4. A writing instrument as claimed in claim 1, said chamber comprising a substantially rectangular space in said end portion of said writing instrument.

5. A writing instrument as claimed in claim 1, said chamber comprising a substantially sector shaped space in said end portion of said writing instrument converging toward a position wherein said seal cap blocks said through hole.

6. A writing instrument as claimed in claim 1, said chamber comprising an obliquely oriented space slideably receiving said seal cap.

7. A writing instrument as claimed in claim 1, said seal cap being connected with a plate having an aperture for receiving the end portion of the writing member.

8. A writing instrument as claimed in claim 1, said seal cap including an annular flat engaging a planar surface surrounding said through hole.

9. A writing instrument as claimed in claim 1, including means including a pushbutton for relatively moving said writing member and said leading end portion of said writing instrument.

10. A writing instrument as claimed in claim 1, including means for relatively moving said writing member and said leading end portion of said writing instrument comprising a front and a back member connected by a sleeve, and biased by a spring toward one another, and being manually movable away from one another, one of said front and back members being fixed to said writing member and the other being connected to said barrel.

11. A writing instrument as claimed in claim 1, including means for relatively moving said writing member and said leading end portion of said writing instrument comprising manually rotatable cam means, and follower means connected to one of said writing instrument and said writing member.

12. A writing instrument comprising:

a sliding cylinder fitted in a barrel such that it can slide in the longitudinal direction thereof;

a pushbutton member connected to the back of said sliding cylinder, said sliding cylinder being biased backward by the action of a spring;

a writing member equipped with a writing tip at its leading end being fitted in said sliding cylinder, said sliding cylinder being formed at its leading end with a through hole through which the writing tip of said writing member can move into and out of said sliding cylinder;

a chamber defining a space formed behind said through hole;

and a gravity actuated removable free-standing seal cap fitted in said chamber, said seal cap being shaped and sized so as to be capable of being fitted on the leading end portion of said writing member and plugging the through hole of said sliding cylinder with an outer circumference thereof by force applied to said seal cap by said writing member.

13. A writing instrument as claimed in claim 12, said writing member being connected so as to be movable with said barrel, said sliding cylinder being movable with said pushbutton member, whereby depression of said pushbutton member advances said sliding cylinder to fully enclose the sides of said writing member.

14. A writing instrument as claimed in claim 12, further including a partition proximate a leading end of said sliding cylinder, and forming one boundary of said space, said partition including a center hole through which said leading end of said writing member may pass.

15. A writing instrument as claimed in claim 14, said partition including means for completely sealing one end of said space.

16. A writing instrument as claimed in claim 14, said partition comprising an abutment surface for said seal cap, whereby said seal cap is removed from said writing member when said writing member is retracted relative to said sliding cylinder.

17. A writing instrument as claimed in claim 12, said space comprising a generally conical chamber, said seal cap having a conical shape.

18. A writing instrument as claimed in claim 17, said seal cap being of a size and shape such that when said seal cap is removed from said writing member, said seal cap is disposed in said conical chamber in a manner not obstructing movement of said writing member through said through hole.

19. A writing instrument as claimed in claim 17, said seal cap and said chamber being relatively slidable such that said seal cap, when removed from said writing member, is movable to a position plugging said through hole when said writing member is retracted.

20. A writing instrument as claimed in claim 17, said generally conical chamber including a plurality of guide grooves for said seal cap.

21. A writing instrument as claimed in claim 12, said seal cap including sealing ring means for sealing said leading end of said writing member.

22. A writing instrument comprising:

a writing member equipped with a writing tip at its leading end and fitted in a sliding cylinder; a mechanism for moving said sliding cylinder forward and backward interposed between said sliding cylinder and said writing member, said sliding cylinder biased backwardly by a spring, said sliding cylinder being formed at its leading end with a through hole through which the writing tip of said writing member is moved into and out of said sliding cylinder, said sliding cylinder being formed at the back of said through hole with longitudinal groove means for accommodating a free-standing seal cap, said seal cap being movable under its own weight by force of gravity in response to movement of said sliding cylinder into a position sealing the writing tip of said writing member by the force of said writing member upon said seal cap, or into a position entering said groove means to thereby not obstruct the advance of said writing member.

23. A writing member as claimed in claim 22, wherein said mechanism for moving said sliding cylinder comprises means connecting said writing member to a manually movable member, said manually movable member being movable against the force of said spring to move said writing member relative to said sliding cylinder.

* * * * *